US011154884B2

(12) United States Patent
Hayward et al.

(10) Patent No.: US 11,154,884 B2
(45) **Date of Patent: *Oct. 26, 2021**

(54) SPRAY GUN AND NOZZLE ASSEMBLY ATTACHMENT

(71) Applicant: 3M INNOVATIVE PROPERTIES COMPANY, St. Paul, MN (US)

(72) Inventors: Bryan J. Hayward, St. Paul, MN (US); Brady P. Haislet, Maple Plain, MN (US); Alexander T. Ebertowski, Burnsville, MN (US); Scott D. Gullicks, Woodbury, MN (US); Anna M. Hegdahl, Brooklyn Park, MN (US); Stephen C. P. Joseph, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 218 days.

This patent is subject to a terminal disclaimer.

(21) Appl. No.: 16/468,570

(22) PCT Filed: Dec. 8, 2017

(86) PCT No.: PCT/IB2017/057757

§ 371 (c)(1),
(2) Date: Jun. 11, 2019

(87) PCT Pub. No.: WO2018/109625

PCT Pub. Date: Jun. 21, 2018

(65) Prior Publication Data

US 2019/0308208 A1 Oct. 10, 2019

Related U.S. Application Data

(60) Provisional application No. 62/433,056, filed on Dec. 12, 2016.

(51) Int. Cl.
*B05B 7/24* (2006.01)
*B05B 15/65* (2018.01)
(Continued)

(52) U.S. Cl.
CPC ..... *B05B 7/2408* (2013.01); *B05B 7/025* (2013.01); *B05B 7/0815* (2013.01);
(Continued)

(58) Field of Classification Search
CPC ..... B05B 15/65; B05B 15/654; B05B 7/025; B05B 7/2478; B05B 7/2467; B05B 7/2408; B05B 7/2489; B05B 7/0815
(Continued)

(56) References Cited

U.S. PATENT DOCUMENTS 5,836,517 A 11/1998 Burns
7,032,839 B2 4/2006 Blette
(Continued)

FOREIGN PATENT DOCUMENTS

DE 19612524 10/1997
DE 202014105806 4/2015
(Continued)

OTHER PUBLICATIONS

International Search Report for PCT International Application No. PCT/162017/057754, dated Mar. 23, 2018, 4 pages.
(Continued)

*Primary Examiner* — Steven J Ganey

(57) ABSTRACT

A liquid spray gun nozzle assembly is disclosed comprising a coating liquid inlet portion comprising a liquid connector for connection to an external liquid source; a coating liquid outlet portion comprising a liquid nozzle for spraying a coating liquid fed into the nozzle assembly through the coating liquid inlet portion, the liquid nozzle being disposed along a spray axis; a coating liquid flow path fluidly con-
(Continued)

necting the coating liquid inlet portion to the liquid nozzle; and a spray gun connection portion opposite the coating liquid outlet portion adapted to connect the liquid spray gun nozzle assembly to a compatible liquid spray gun body. The spray gun connection portion comprises a nozzle assembly sealing surface adapted to seal the liquid spray gun nozzle assembly to the compatible liquid spray gun body, the nozzle assembly sealing surface comprising first and second sealing members that are each circular and concentric with one another.

20 Claims, 28 Drawing Sheets

(51) Int. Cl.
*B05B 7/08* (2006.01)
*B05B 15/654* (2018.01)
*B05B 7/02* (2006.01)

(52) U.S. Cl.
CPC ..... *B05B 7/2467* (2013.01); *B05B 7/2489* (2013.01); *B05B 15/65* (2018.02); *B05B 15/654* (2018.02)

(58) Field of Classification Search
USPC ..... 239/290, 296, 345, 346, 379, 525, 526, 239/600
See application file for complete search history.

(56) References Cited

U.S. PATENT DOCUMENTS 8,590,809 B2 * 11/2013 Escoto, Jr. ..... B05B 7/2478 239/290
9,192,950 B2 * 11/2015 Carleton ..... B05B 7/2478
2003/0025000 A1 2/2003 Schmon
2003/0052190 A1 3/2003 Ulrich
2004/0016825 A1 1/2004 Petrie
2005/0242207 A1 11/2005 Tejeda
2006/0065761 A1 3/2006 Joseph
2013/0020414 A1 1/2013 Thomason
2013/0092760 A1 4/2013 Joseph
2013/0221130 A1 8/2013 Joseph
2013/0327850 A1 12/2013 Joseph
2014/0246519 A1 9/2014 Johnson
2015/0028131 A1 1/2015 Joseph
2015/0069142 A1 3/2015 Duncan
2015/0090614 A1 4/2015 Joseph
2016/0052003 A1 2/2016 Escoto, Jr.
2016/0151797 A1 6/2016 Joseph
2016/0175861 A1 6/2016 Gullicks
2017/0203887 A1 7/2017 Hegdahl

FOREIGN PATENT DOCUMENTS

WO 2015-191323 12/2015
WO 2016-033415 3/2016
WO 2016-138888 9/2016
WO 2017-013131 1/2017
WO 2017-123707 7/2017
WO 2017-123714 7/2017
WO 2017-123715 7/2017
WO 2017-123718 7/2017
WO 2018-104826 6/2018
WO 2018-104870 6/2018
WO 2018-104871 6/2018
WO 2018-109624 6/2018

OTHER PUBLICATIONS

International Search Report for PCT International Application No. PCT/162017/057757, dated Mar. 23, 2018, 4 pages.

* cited by examiner

SPRAY GUN AND NOZZLE ASSEMBLY ATTACHMENT

CROSS REFERENCE TO RELATED APPLICATIONS

This application is a national stage filing under 35 U.S.C. 371 of PCT/I132017/057757, filed Dec. 8, 2017, which claims the benefit of U.S. Application No. 62/433,056, filed Dec. 12, 2016, the disclosure of which is incorporated by reference in its/their entirety herein.

BACKGROUND

Spray guns are known for the application of coatings to various substrates. It has been known to provide spray guns with removable nozzle assemblies to facilitate easier cleaning of wetted parts and to allow for exchanging nozzles of differing types for different applications. There is a need for improved connections between removable nozzle assemblies and spray gun bodies.

SUMMARY OF THE INVENTION

Exemplary embodiments according to the present disclosure include, but are not limited to, the embodiments listed below, which may or may not be numbered for convenience. Several additional embodiments, not specifically enumerated in this section, are disclosed within the accompanying detailed description.

EMBODIMENTS

1. A liquid spray gun nozzle assembly comprising a coating liquid inlet portion comprising a liquid connector for connection to an external liquid source;

a coating liquid outlet portion comprising a liquid nozzle for spraying a coating liquid fed into the nozzle assembly through the coating liquid inlet portion, the liquid nozzle being disposed along a spray axis;

a coating liquid flow path fluidly connecting the coating liquid inlet portion to the liquid nozzle;

a spray gun connection portion opposite the coating liquid outlet portion adapted to connect the liquid spray gun nozzle assembly to a compatible liquid spray gun body, the spray gun connection portion comprising an outer wall comprising a radially-outward facing surface;

a first camming member disposed on the radially-outward facing surface and comprising first end, a second end, and a camming surface facing the coating liquid outlet portion;

a first access window proximate the first end of the first camming member.

2. The liquid spray gun nozzle assembly of Embodiment 1 wherein the spray gun connection portion further comprises a second camming member comprising a first end, a second end, and a camming surface facing the coating liquid outlet portion; wherein the first access window separates the first end of the first camming member from the second end of the second camming member; and a second access window separating the first end of the second camming member from the second end of the first camming member.

3. The liquid spray gun nozzle assembly of Embodiment 2 wherein the second radially-outward facing camming surface comprises a portion that is inclined relative to a base plane defined normally to the spray axis.

4. The liquid spray gun nozzle assembly of any of Embodiments 1-3 wherein the liquid connector comprises a quick-connect coupler.

5. The liquid spray gun nozzle assembly of any of Embodiments 1-4 wherein the first radially-outward facing camming surface comprises a portion that is inclined relative to a base plane defined normally to the spray axis.

6. The liquid spray gun nozzle assembly of any of Embodiments 1-5 wherein the spray gun connection portion comprises a nozzle assembly sealing surface adapted to seal the liquid spray gun nozzle assembly to the compatible liquid spray gun body.

7. The liquid spray gun nozzle assembly of Embodiment 6 wherein the first camming surface is adapted to interact with a complementary camming lug on the compatible liquid spray gun body to pull the liquid spray gun nozzle assembly along the spray axis to locate the nozzle assembly sealing surface in sealing relation with the compatible liquid spray gun body.

8. The liquid spray nozzle of Embodiment 7 comprising a second camming surface, wherein the first and second camming surfaces are adapted to interact with complementary camming lugs on the compatible liquid spray gun body to pull the liquid spray gun nozzle assembly along the spray axis to locate the nozzle assembly sealing surface in sealing relation with the compatible liquid spray gun body.

9. The liquid spray gun nozzle assembly of any of Embodiments 6-8 wherein the nozzle assembly sealing surface comprises a first sealing member that is circular.

10. The liquid spray gun nozzle assembly of any of Embodiments 6-8 wherein the nozzle assembly sealing surface comprises first and second sealing members that are each circular and concentric with one another.

11. The liquid spray gun nozzle assembly of Embodiment 10 wherein the first and second sealing members are concentric about the spray axis.

12. The liquid spray gun nozzle assembly of any of Embodiments 10 or 11 wherein, upon connection to the compatible liquid spray gun body, a shaping air zone is isolated between the first and second sealing members.

13. The liquid spray gun nozzle assembly of any of Embodiments 10-12 wherein, upon connection to the compatible liquid spray gun body, a center air zone is isolated within the second sealing member.

14. The liquid spray gun nozzle assembly of any of Embodiments 10-13 wherein the nozzle assembly sealing surface comprises a third sealing member that is circular and concentric with the first and second sealing members.

15. The liquid spray gun nozzle assembly of Embodiment 14 wherein, upon connection to the compatible liquid spray gun body, a shaping air zone is isolated between the second and third sealing members.

16. The liquid spray gun nozzle assembly of any of Embodiments 14 or 15 wherein, upon connection to the compatible liquid spray gun body, a liquid needle is isolated within the third sealing member.

17. The liquid spray gun nozzle assembly of any of Embodiments 1-16 wherein the first camming surface is adapted to interact with a complementary camming lug on the compatible liquid spray gun body to pull the liquid spray gun nozzle assembly along the spray axis and against the compatible liquid spray gun body without rotation of the liquid spray gun nozzle assembly.

18. The liquid spray nozzle of Embodiment 17 comprising a second camming surface, wherein the first and second camming surfaces are adapted to interact with complementary camming lugs on the compatible liquid spray gun body to pull the liquid spray gun nozzle assembly along the spray axis and against compatible liquid spray gun body without rotation of the liquid spray gun nozzle assembly.

19. The liquid spray gun nozzle assembly of any of Embodiments 1-18 wherein the first access window provides access for a complementary camming lug on the compatible liquid spray gun body to reach a camming surface of the first radially-outward facing camming member.

20. The liquid spray gun nozzle assembly of Embodiment 19 comprising a second access window, wherein the first and second access windows provide access for complementary camming lugs on the compatible liquid spray gun body to reach camming surfaces of the first and second radially-outward facing camming members.

21. A liquid spray gun assembly comprising a liquid spray gun body; and a liquid spray gun nozzle assembly according to any of Embodiments 1-20.

22. The liquid spray gun assembly of Embodiment 21 wherein the liquid spray gun body comprises a captured rotatable locking ring for connection of the liquid spray gun nozzle assembly.

23. The liquid spray gun assembly of Embodiment 22 wherein the captured rotatable locking ring comprises first and second camming lugs adapted to interact with the first and second camming surfaces on the liquid spray gun nozzle assembly.

24. The liquid spray gun assembly of Embodiment 23 wherein the captured rotatable locking ring is rotatable about the spray axis to an assembly position and a locked position, wherein, in the assembly position, the first and second camming lugs are aligned with the first and second access windows, respectfully, to allow installation or removal of the liquid spray gun nozzle assembly; and in the locked position, the first and second camming lugs bear against the first and second camming surfaces, respectfully, to lock the liquid spray gun nozzle assembly against the liquid spray gun body.

25. The liquid spray gun assembly of Embodiment 24 wherein rotation of the captured rotatable locking ring from the assembly position to the locked position is less than 180 degrees about the spray axis.

26. The liquid spray gun assembly of Embodiment 25 wherein rotation of the captured rotatable locking ring from the assembly position to the locked position is less than 140 degrees about the spray axis.

27. The liquid spray gun assembly of any of Embodiments 22-26 wherein the captured rotatable locking ring is installable onto the liquid spray gun body by pushing the captured rotatable locking ring along the spray axis, and is removable from the liquid spray gun body by pulling along the spray axis.

28. The liquid spray gun assembly of Embodiment 27 wherein the captured rotatable locking ring is rotatable about the spray axis to an assembly position and a locked position, wherein the captured rotatable locking ring is installable onto and removable from the liquid spray gun body when rotated to the assembly position, but not removable when rotated to the locked position.

29. The liquid spray gun assembly of any of Embodiments 27-28 wherein the captured rotatable locking ring is installable and removable from the liquid spray gun body via a snapping feature.

30. The liquid spray gun assembly of any of Embodiments 27-29 wherein the captured rotatable locking ring is installable and removable from the liquid spray gun body without the use of a tool.

31. A liquid spray gun body comprising captured rotatable locking ring adapted to allow connection of a compatible liquid spray gun nozzle assembly, wherein the liquid spray gun body is free of passages for a coating liquid.

32. The liquid spray gun body of Embodiment 31 wherein the captured rotatable locking ring comprises a first camming lug adapted to interact with a first camming surfaces on a compatible liquid spray gun nozzle assembly.

33. The liquid spray gun body of Embodiment 32 wherein the captured rotatable locking ring comprises a second camming lug adapted to interact with a second camming surface on a compatible liquid spray gun nozzle assembly.

34. The liquid spray gun body of any of Embodiments 31-33 wherein the captured rotatable locking ring is rotatable to an assembly position and a locked position, wherein, in the assembly position, the compatible liquid spray gun nozzle assembly is installable and removable; and in the locked position, the compatible liquid spray gun nozzle assembly is lockable against the liquid spray gun body.

35. The liquid spray gun body of Embodiment 34 wherein rotation of the captured rotatable locking ring from the assembly position to the locked position is less than 180 degrees about the spray axis.

36. The liquid spray gun body of Embodiment 35 wherein rotation of the captured rotatable locking ring from the assembly position to the locked position is less than 140 degrees about the spray axis.

37. The liquid spray gun body of any of Embodiments 31-36 wherein the captured rotatable locking ring is installable onto the liquid spray gun body by pushing the captured rotatable locking ring onto the liquid spray gun body, and is removable from the liquid spray gun body by pulling from the liquid spray gun body.

38. The liquid spray gun body of Embodiment 37 wherein the captured rotatable locking ring is rotatable about the spray axis to an assembly position and a locked position, wherein the captured rotatable locking ring is installable onto and removable from the liquid spray gun body when rotated to the assembly position, but not removable when rotated to the locked position.

39. The liquid spray gun body of any of Embodiments 37-38 wherein the captured rotatable locking ring is installable and removable from the liquid spray gun body via a snapping feature.

40. The liquid spray gun body of any of Embodiments 37-39 wherein the captured rotatable locking ring is installable and removable from the liquid spray gun body without the use of a tool.

41. A method of using a liquid spray gun comprising installing a liquid spray gun nozzle assembly according to any of Embodiments 1-20 onto a liquid spray gun body according to any of Embodiments 31-40.

42. The method of Embodiment 41 comprising removing the liquid spray nozzle assembly from the liquid spray gun body.

43. A method of using a liquid spray gun body according to any of Embodiments 37-40 comprising removing the captured rotatable locking ring from the liquid spray gun body for cleaning and then reinstalling the captured rotatable locking ring onto the liquid spray gun body.

44. A method of using a liquid spray gun assembly according to any of Embodiments 21-30 comprising placing the captured rotatable locking ring into the assembly position;

aligning the first camming lug with the first access window;

translating the liquid spray gun nozzle assembly along the spray axis to cause the first camming lug to pass through the first access window;

rotating the captured rotatable locking ring about the spray axis to cause the first camming lug to engage the first camming surface; and continuing rotation of the captured rotatable locking ring into the locked position to cause the liquid spray gun nozzle assembly to be locked in sealing relation against the liquid spray gun body.

45. The method of Embodiment 44 comprising aligning the second camming lug with the second access window;

translating the liquid spray gun nozzle assembly along to spray axis to cause the second camming lug to pass through the second access window; and rotating the captured rotatable locking ring about the spray axis to cause the second camming lug to engage the second camming surface.

46. The method of any of Embodiments 44-45 comprising rotating the captured rotatable locking ring from the locked position into the assembly position; and pulling the liquid spray gun nozzle assembly along the spray axis to remove the liquid spray gun nozzle assembly from the liquid spray gun body.

47. The method of Embodiment 46 comprising after removing the liquid spray gun nozzle assembly from the liquid spray gun body, removing the captured rotatable locking ring from the liquid spray gun body by pulling along the spray axis.

48. The method of Embodiment 47 comprising after removing the captured rotatable locking ring from the liquid spray gun body, reinstalling the captured rotatable locking ring onto the liquid spray gun body by pushing along the spray axis.

49. A liquid spray gun nozzle assembly for a pressure-fed liquid spray gun comprising a coating liquid inlet portion comprising a liquid connector for connection to an external liquid source;

a coating liquid outlet portion comprising a liquid nozzle for spraying a coating liquid fed into the nozzle assembly through the coating liquid inlet portion, the liquid nozzle being disposed along a spray axis;

a coating liquid flow path fluidly connecting the coating liquid inlet portion to the liquid nozzle;

a spray gun connection portion opposite the coating liquid outlet portion adapted to connect the liquid spray gun nozzle assembly to a compatible liquid spray gun body, the spray gun connection portion comprising a nozzle assembly sealing surface adapted to seal the liquid spray gun nozzle assembly to the compatible liquid spray gun body, the nozzle assembly sealing surface comprising first and second sealing members that are each circular and concentric with one another.

50. The liquid spray gun nozzle assembly of Embodiment 49 wherein the first and second sealing members are concentric about a spray axis.

51. The liquid spray gun nozzle assembly of any of Embodiments 49 or 50 wherein, upon connection to the compatible liquid spray gun body, a shaping air zone is isolated between the first and second sealing members.

52. The liquid spray gun nozzle assembly of any of Embodiments 49-51 wherein, upon connection to the compatible liquid spray gun body, a center air zone is isolated within the second sealing member.

53. The liquid spray gun nozzle assembly of any of Embodiments 49-52 wherein the nozzle assembly sealing surface comprises a third sealing member that is circular and concentric with the first and second sealing members.

54. The liquid spray gun nozzle assembly of Embodiment 53 wherein, upon connection to the compatible liquid spray gun body, a shaping air zone is isolated between the second and third sealing members.

55. The liquid spray gun nozzle assembly of any of Embodiments 53 or 54 wherein, upon connection to the compatible liquid spray gun body, a liquid needle is isolated within the third sealing member.

56. The liquid spray gun nozzle assembly of any of Embodiments 49-55 wherein the liquid connector comprises a first connector portion comprising a first connector format comprising a guide surface and a retention structure.

57. The liquid spray gun nozzle assembly of Embodiment 56 further comprising an adapter configured to allow connection of the liquid connector to an external liquid source, the adapter comprising a second connector portion comprising a second connector format configured to connect to the first connector format on the liquid connector for assembly onto the liquid connector.

58. The liquid spray gun nozzle assembly of Embodiment 57 wherein the second connector format comprises a tracking face an a lock structure, wherein the lock structure is configured to selectively interface with the retention structures, and the tracking face is configured to interface with the guide surface.

59. A liquid spray gun assembly comprising a liquid spray gun body; and a liquid spray gun nozzle assembly according to any of Embodiments 49-58.

60. The liquid spray gun assembly of Embodiment 59 wherein the liquid spray gun body comprises a captured rotatable locking ring for connection of the liquid spray gun nozzle assembly.

61. The liquid spray gun assembly of Embodiment 60 wherein the captured rotatable locking ring comprises first and second camming lugs adapted to interact with the first and second camming surfaces on the liquid spray gun nozzle assembly.

62. The liquid spray gun assembly of Embodiment 61 wherein the captured rotatable locking ring is rotatable about the spray axis to an assembly position and a locked position, wherein, in the assembly position, the first and second camming lugs are aligned with the first and second access windows, respectfully, to allow installation or removal of the liquid spray gun nozzle assembly; and in the locked position, the first and second camming lugs bear against the first and second camming surfaces, respectfully, to lock the liquid spray gun nozzle assembly against the liquid spray gun body.

63. The liquid spray gun assembly of Embodiment 62 wherein rotation of the captured rotatable locking ring from the assembly position to the locked position is less than 180 degrees about the spray axis.

64. The liquid spray gun assembly of Embodiment 63 wherein rotation of the captured rotatable locking ring from the assembly position to the locked position is less than 140 degrees about the spray axis.

65. The liquid spray gun assembly of any of Embodiments 60-64 wherein the captured rotatable locking ring is installable onto the liquid spray gun body by pushing the captured rotatable locking ring along the spray axis, and is removable from the liquid spray gun body by pulling along the spray axis.

66. The liquid spray gun assembly of Embodiment 65 wherein the captured rotatable locking ring is rotatable about the spray axis to an assembly position and a locked position, wherein the captured rotatable locking ring is installable onto and removable from the liquid spray gun body when rotated to the assembly position, but not removable when rotated to the locked position.

67. The liquid spray gun assembly of any of Embodiments 65-66 wherein the captured rotatable locking ring is installable and removable from the liquid spray gun body via a snapping feature.

68. The liquid spray gun assembly of any of Embodiments 65-67 wherein the captured rotatable locking ring is installable and removable from the liquid spray gun body without the use of a tool.

69. A method of using a liquid spray gun assembly according to any of Embodiments 59-68 comprising installing the liquid spray gun nozzle assembly onto the liquid spray gun body.

70. The method of Embodiment 69 comprising removing the liquid spray nozzle assembly from the liquid spray gun body.

The words "preferred" and "preferably" refer to embodiments described herein that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the terms "comprises" and variations thereof do not have a limiting meaning where these terms appear in the accompanying description. Moreover, "a," "an," "the," "at least one," and "one or more" are used interchangeably herein.

Relative terms such as left, right, forward, rearward, top, bottom, side, upper, lower, horizontal, vertical, and the like may be used herein and, if so, are from the perspective observed in the particular figure. These terms are used only to simplify the description, however, and not to limit the scope of the invention in any way.

Reference throughout this specification to "one embodiment," "certain embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention. Furthermore, the particular features, structures, materials, or characteristics may be combined in any suitable manner in one or more embodiments.

The above summary is not intended to describe each embodiment or every implementation of the reservoirs and associated vent assemblies described herein. Rather, a more complete understanding of the invention will become apparent and appreciated by reference to the following Description of Illustrative Embodiments and claims in view of the accompanying figures of the drawing.

These and other aspects of the invention will be apparent from the detailed description below. In no event, however, should the above summaries be construed as limitations on the claimed subject matter, which subject matter is defined solely by the attached claims, as may be amended during prosecution.

BRIEF DESCRIPTION OF THE DRAWINGS

Throughout the specification, reference is made to the appended drawings, where like reference numerals designate like elements, and wherein.

DETAILED DESCRIPTION

Figure 17:
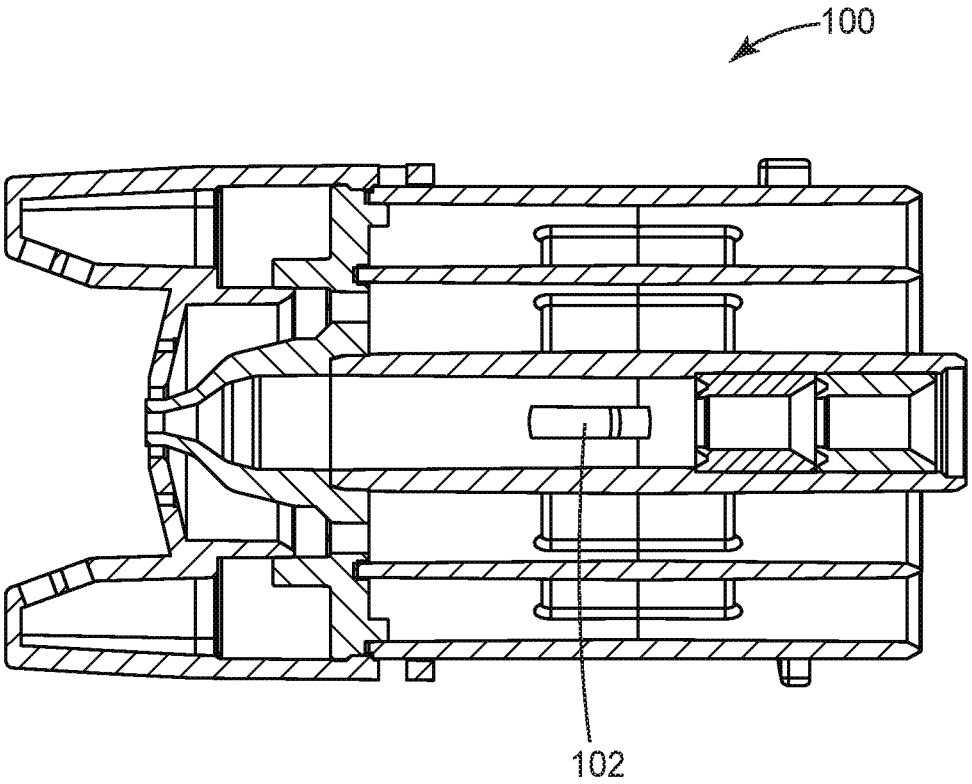
FIG. 17 is a cross-section view thereof taken at 17-17 of FIG. 9.
Figure 18:
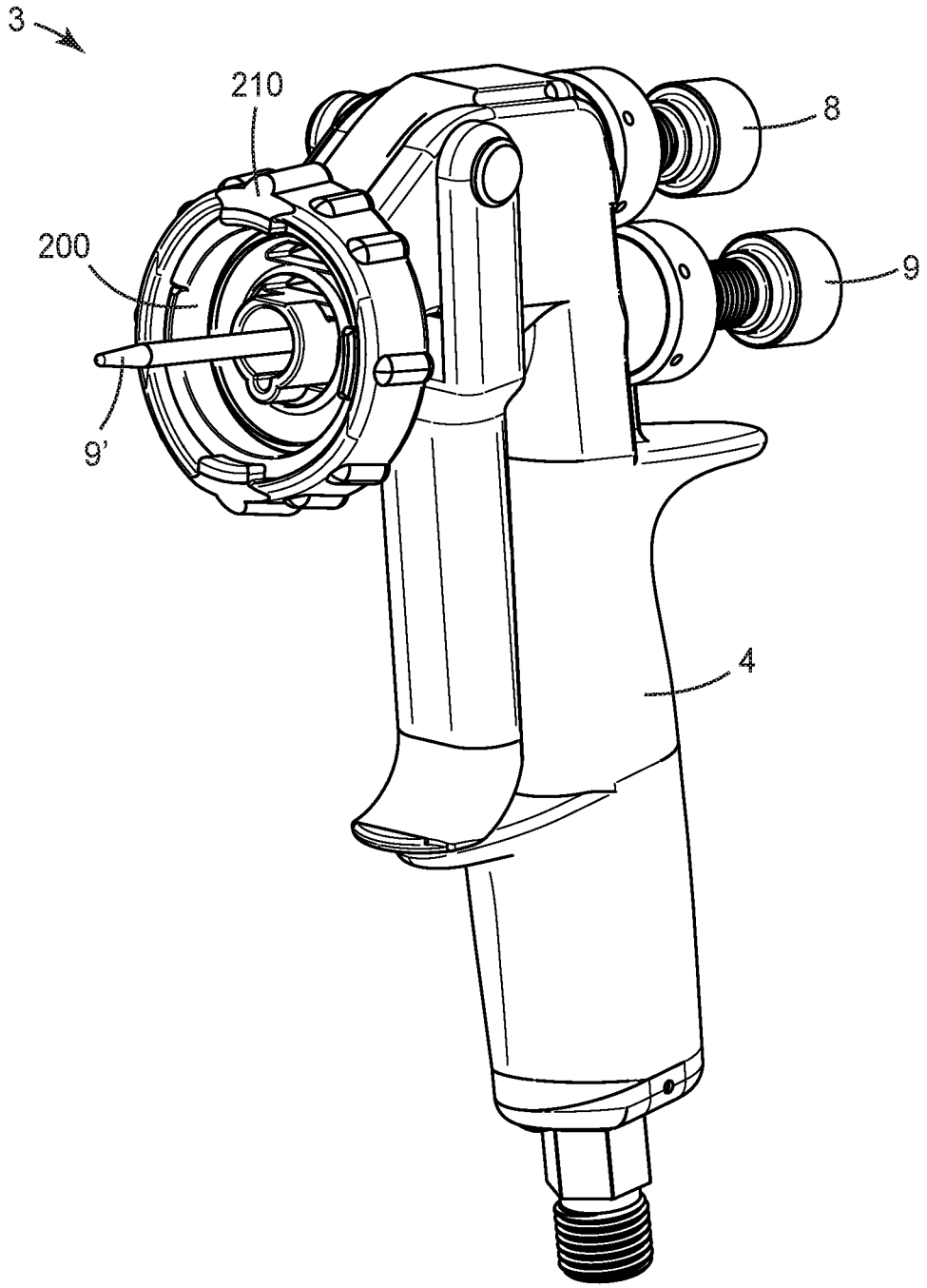
FIG. 18 is an isometric view of an exemplary liquid spray gun configured to receive a liquid spray gun nozzle assembly according to the present disclosure.
Figure 19:
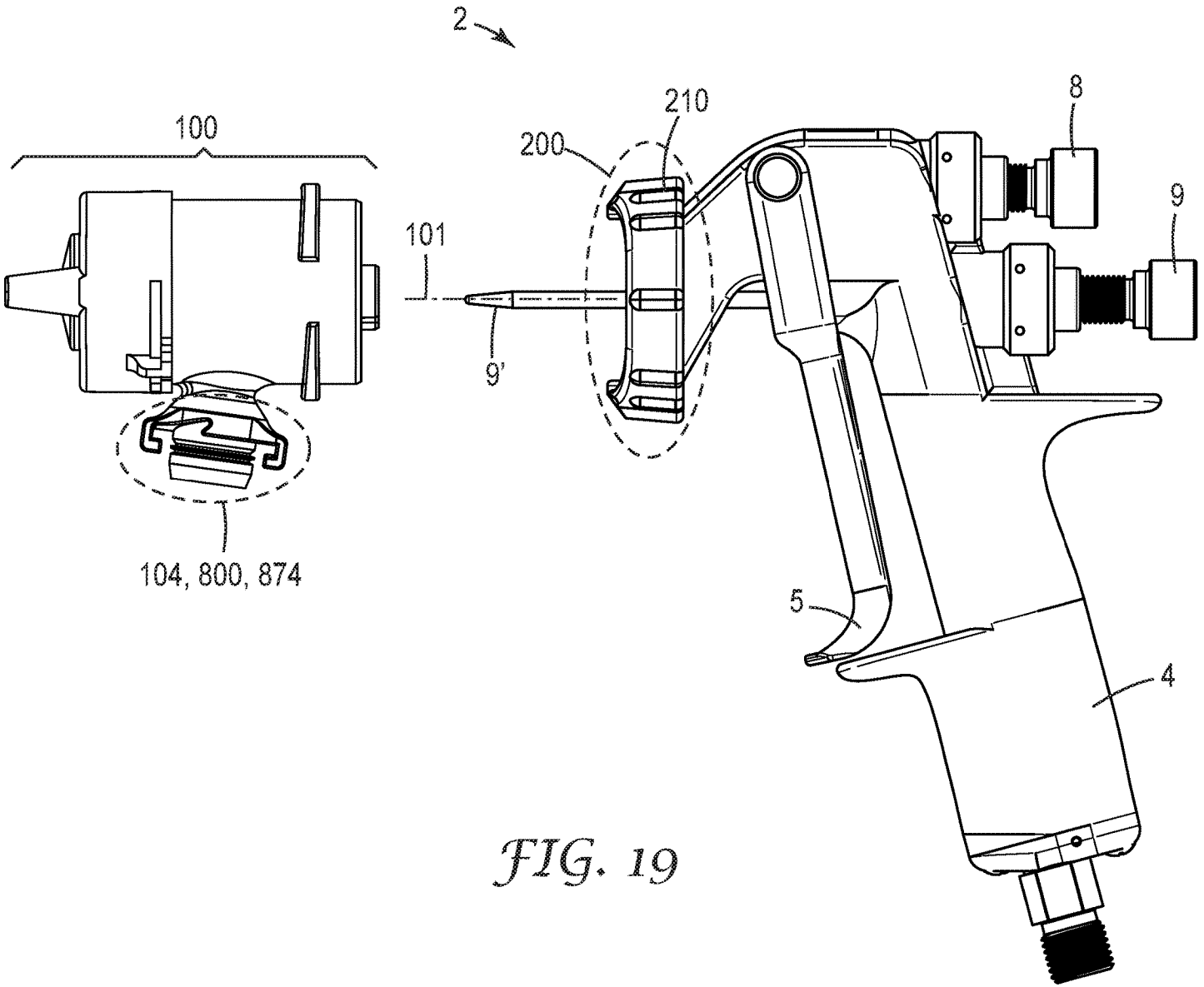
FIG. 19 is a right-side exploded assembly view of a liquid spray gun nozzle assembly in a detached position relative to a liquid spray gun.

Referring to FIGS. 18 and 19, an exemplary embodiment of a liquid spray gun 2 is shown. The liquid spray gun 2 comprises a handle 4, a trigger 5, a connection for an external pressure source 6, a liquid spray gun body 3, a liquid needle adjustment knob 9, a shaping air control knob 8, and a liquid spray gun nozzle assembly 100. The liquid spray gun nozzle assembly 100 comprises a spray gun connection portion 120 that is removable and attachable at a nozzle assembly connection portion 200 on the spray gun body 3. Embodiments of a liquid spray gun nozzle assembly 100 are shown, for example, in FIGS. 1-17 and 19.

As shown, the nozzle assembly connection portion 120 facilitates the attachment of the paint spray gun nozzle assembly 100 to a nozzle assembly connection portion 200 of a paint spray gun body by way of a locking ring 210 of the type described in U.S. patent application No. 62/430,383, entitled "Spray Gun and Nozzle Assembly Attachment," (herein referred to as "62/430,383"), the disclosure of which is herein incorporated by reference in its entirety. An exemplary liquid spray gun nozzle assembly 100 is shown in a detached state from such a liquid spray gun in FIG. 19 herein.

Figure 1:
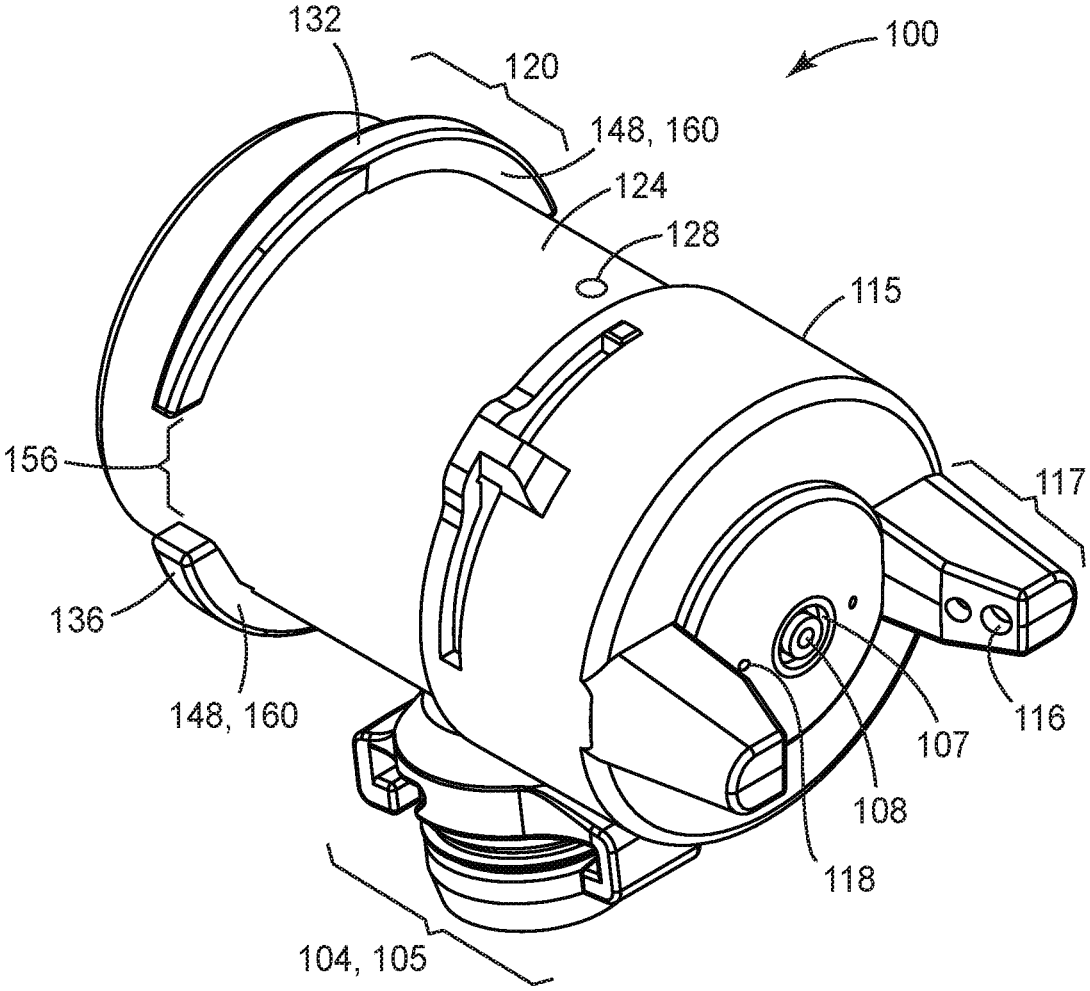
FIGS. 1-8 are isometric views of an exemplary liquid spray guns nozzle assembly according to the present disclosure.
Figure 2:
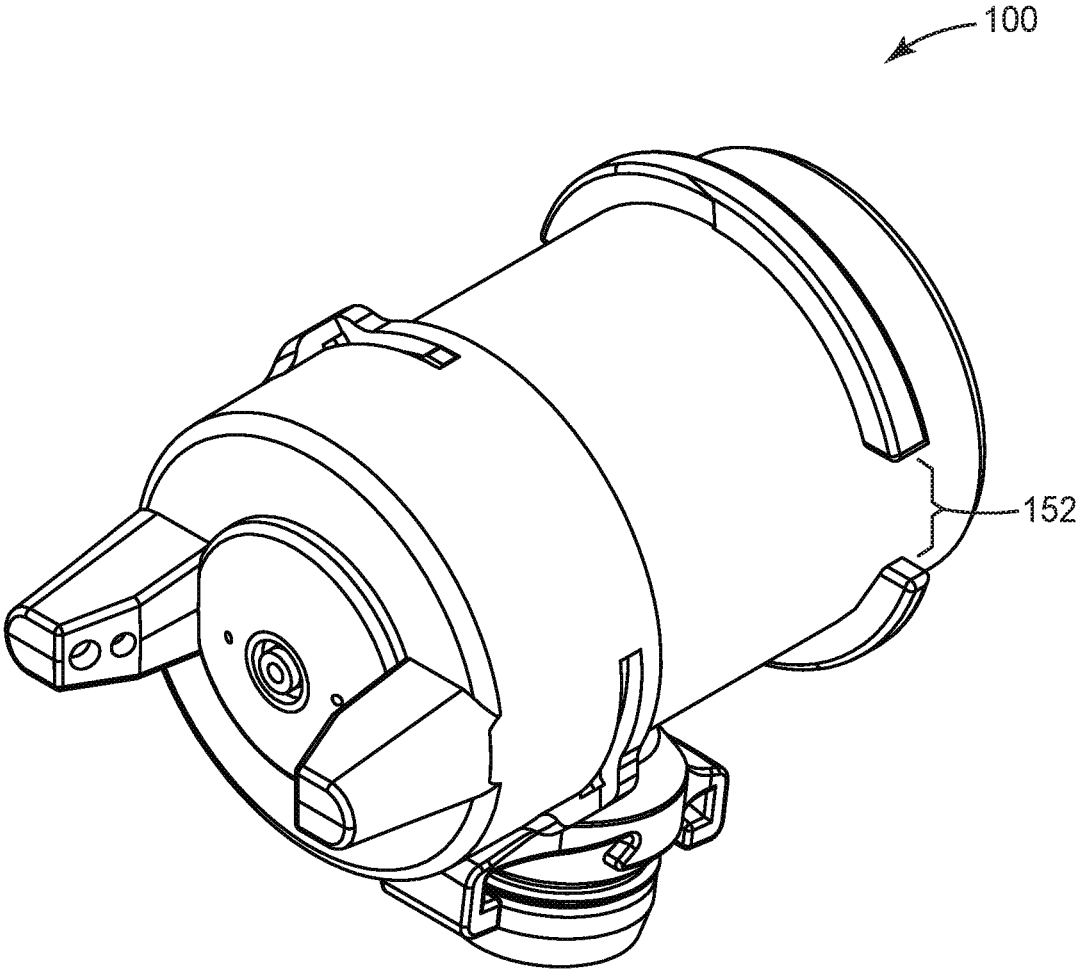
Figure 3:
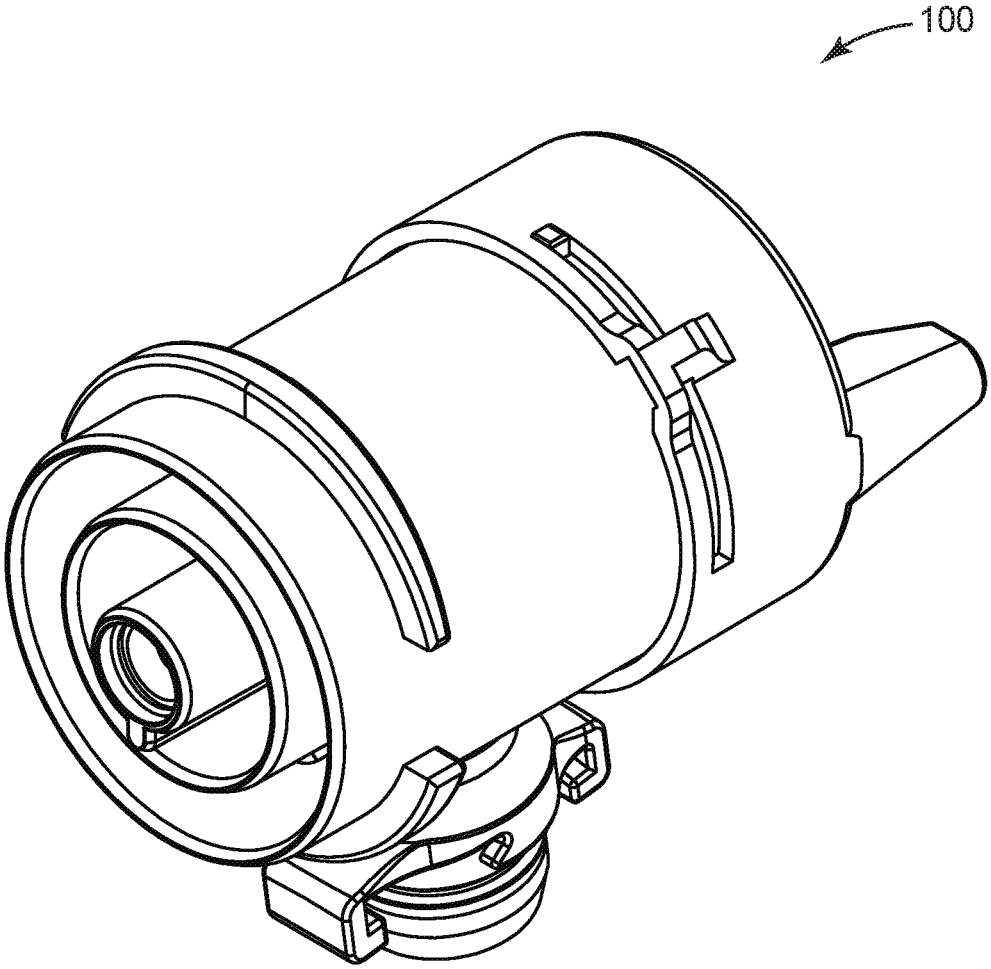

The liquid spray gun nozzle assembly 100 comprises one end of a liquid spray gun coating liquid connector 104 (located at a coating liquid inlet portion 102), through which a coating liquid is supplied to the liquid spray gun 2 from an external liquid source 6'. As shown, for example, in FIGS. 1 and 3, the liquid connector 104 comprises a quick-connect coupler 105 (described in further detail elsewhere. Another a quick-connect coupler is described, for example, in U.S. patent application No. 62/430,388, entitled "Paint Spray Gun Coating Liquid Connector," the disclosure of which is herein incorporated by reference in its entirety. Other liquid connectors are possible. For example, the liquid connector 104 may comprise connections, or features of connections, described in WO2017/123707; WO2017123714; WO2017/123715; WO2017/123718; and/or in U.S. Pat. Pub. Nos. 2013/0221130 A1 ("Spraygun with built-in quick-fit connector"); 2004/0016825 A1 ("Mixing cup adapting assembly"); 2015/0090614 A1 ("Apparatus for spraying liquids, and adapters and liquid reservoirs suitable for use therewith"); 2006/0065761 A1 ("Easy clean spray gun"); 2016/0052003 A1 ("Liquid Spray gun, spray gun platform, and spray head assembly"); and/or 2015/0028131 ("Spray gun having internal boost passageway"), the disclosures of which are hereby incorporated by reference in their entireties. In particular, the liquid connector 104 may comprise a gravity-fed spray gun paint reservoir connector, an example of which is shown in FIG. 2 of 62/430,383.

In the embodiments shown the liquid connector 104 comprises a quick-connect coupler 105 that comprises a first connector portion 800 on the spray gun liquid nozzle assembly 100 and a second connector portion 900 on an adaptor 902 that facilitates connection to an external liquid source 6' (as shown in 62/430,383).

The external liquid source 6' may be a container that is directly affixed to the paint spray gun nozzle assembly 100, or may comprise a remote reservoir that is connected to the paint spray gun nozzle assembly 100 by way of a hose. In some embodiments, the external liquid source is remotely pressurized (via a pressurized canister, a remote pump, or the like) to force the coating liquid into the paint spray gun nozzle assembly 100. In other embodiments, the coating liquid may be forced or pulled into the paint spray gun nozzle assembly 100 under the force of gravity, by way of a negative pressure induced by a venturi at the liquid nozzle 108, by a local pump, or through a combination of the above.

As shown, the first connector portion 800 comprises a first connector format 874 having features corresponding generally to the first connector format 74 described in U.S. patent application publication number US2017/0203887, the disclosure of which is herein incorporated by reference in its entirety. Meanwhile, the second connector portion 900 comprises a second connector format 976 corresponding generally to the second connector format 76 described in US2017/0203887. The adapter 902 (with second connector format 976) is brought into position against the first connector format 874 and rotated into a locking configuration therewith as shown (and as described in US2017/0203887). Although such features and their corresponding function(s) are described in US2017/0203887 (and incorporated by reference herein), portions of such description are provided herein for reference.

For example, as shown, the first connection format 874 includes a platform 250, a first retention structure 252*a*, and a second retention structure 252*b*. In general terms, the platform 250 and the retention structures 252*a*, 252*b* are formed at or project from a location external the spout 72, and are collectively configured to facilitate selective connection or mounting with the complementary second connection format 976 of the adaptor 902.

The platform 250 terminates at or defines a guide surface 260 that revolves about the spout 72. Geometry of the guide surface 260 can be viewed as providing first and second guide segments 262*a*, 262*b* separated by first and second undercuts or trapping regions 264*a*, 264*b*. Relative to a rotational direction defined by revolution of the guide surface 260 about the spout 72 (clockwise or counterclockwise), the first guide segment 262*a* extends circumferentially in the clockwise direction from the first undercut 264*a* to the second undercut 264*b* and has a geometry generating a lead-in region 266 and a ramp region 268. Relative to the clockwise direction, then, the lead-in region 266 is "ahead" or "upstream" of the ramp region 268. Similarly, the second guide segment 262*b* can be viewed as extending circumferentially in the clockwise direction from the second undercut 264*b* to the first undercut 264*a*, and has a geometry generating a lead-in region 266 and a ramp region 268.

The guide segments 262*a*, 262*b* can be substantially identical in some embodiments such that the following description of the first guide segment 262*a* applies equally to the second guide segment 262*b*. The first guide segment 262*a* is located to correspond with the first retention structure 252*a*. A major plane of the lead-in region 266 can be substantially flat (i.e., within 5% of a truly flat shape) and substantially perpendicular (i.e., within 5% of a truly perpendicular relationship) to the central axis A. The ramp region 268 tapers longitudinally upward (relative to the upright orientation of, e.g., FIG. 12) in extension from the lead-in region 266 to the second undercut 264*b*, creating a partial helical shape. Thus, the lead-in region 266 is longitudinally or vertically "below" the ramp region 268 (relative to the upright orientation of FIG. 12), and a major plane of the ramp region 268 is oblique to the major plane of the lead-in region 266 (and is not substantially perpendicular to the central axis A). A transition line or zone 270 is defined at an intersection of the lead-in and ramp regions 266, 268 and is generally aligned with the first retention structure 252*a*.

The first and second undercuts 264*a*, 264*b* can be substantially identical, and can be equidistantly spaced about the spout 72. Commensurate with the descriptions above, the first undercut 264*a* is formed at, or defines, a transition between the ramp region 268 of the second guide segment 262*b* and the lead-in region 266 of the first guide segment 262*a*. A shoulder or retention feature 290 is defined by the undercut 264*a*, extending between a leading end 292 of the first guide segment 262*a* and a trailing end 294 of the second guide segment 262*b*. A major plane of the shoulder 290 is non-parallel relative to the major plane of the lead-in region 266 and relative to the major pane of the ramp region 268, with the shoulder 290 projecting outwardly below (relative to upright orientation of FIG. 12) the second segment ramp region 268.

The retention structures 252*a*, 252*b* can be identical such that the following description of the first retention structure 252*a* applies equally to the second retention structure 252*b*. The first retention structure 252*a* is associated with the first segment 262*a* of the guide surface 260, and includes an arm 300 and a tab 302. The arm 300 is radially spaced from the spout 72, and projects axially upwardly from the wall 200. The tab 302 projects radially inwardly from the arm 300.

The first retention structure 252*a* can be viewed as defining opposing, entrance and exit ends 310, 312. Relative to the rotational directions described above, the entrance end 310 is "ahead" or "upstream" of the exit end 312. A capture region 314 is defined by the first guide segment 262*a*, the arm 300 and the tab 302 for receiving a corresponding feature of the second connection format 976.

More particularly, projection of the arm 300 defines an enclosure surface 320. The enclosure surface 320 faces and is radially spaced from an exterior of the spout 72. The tab 302 projects radially inwardly relative to the enclosure surface 320, and defines an engagement surface 322 and an alignment surface 324. The engagement surface 322 faces and is longitudinally spaced from the first guide segment 262*a*. The alignment surface 324 faces, and is radially spaced from an exterior of, the spout 72. Dimensions of the radial spacing between the spout 72 and the engagement surface 322, and between the spout 72 and the alignment surface, correspond with geometry features of the adaptor 54.

Geometry of the first guide segment 262*a* and the engagement surface 322 is configured to facilitate a wedge-like, locked engagement with corresponding features of the second connection format 976. The tab 302 is in general alignment with the transition line 270 between the lead-in region 266 and the ramp region 268. A shape of the engagement surface 322 may define a wedging section 330 and an optional clearance section 332. The wedging section 330 extends from the entrance end 310, and is aligned with or disposed over the lead-in region 266. The clearance section 332 extends from the wedging section 330 to the exit end 312, and is aligned with or disposed over the ramp region 268. An intersection of the wedging and clearance sections 330, 332 is generally aligned with the transition line 270. A major plane of the engagement surface 322 along the wedging section 330 is non-coplanar with a major plane along the clearance section 332.

The wedging section 330 is substantially flat (i.e., within 5% of a truly flat shape), and a plane of the wedging section 330 is non-parallel with the plane of the lead-in region 266. For example, planes of the wedging section 330 and the lead-in region 266 combine to define an included angle on the order of 1-70 degrees, for example in the range of 1-30 degrees. With this construction, the longitudinal spacing or height of the capture region 314 tapers from the entrance end 310 toward the exit end 312, for example tapering to a smallest dimension at the transition line 270. Due to this tapering or wedge-like shape, a rigid body initially inserted into the capture region 314 at the entrance end 310 and then directed toward the exit end 312 can become frictionally wedged or engaged within the capture region 314 as described below.

The clearance section 332, where provided, can also be substantially flat, and a plane of the clearance section 332 is non-parallel with a major plane of the ramp region 268. The planes of the clearance section 332 and the ramp region 268 are arranged such that the longitudinal spacing or height of the capture region 314 expands in a direction of the exit end 312, for example expanding or increasing from the transition line 270 to the exit end 312.

The retention structures 252*a*, 252*b* may be arranged such that tapering then expanding shapes of the capture region 314 of each retention structure 252*a*, 252*b* are in the same rotational direction relative to the central axis A. For example, the entrance end 310 of the first retention structure 252*a* is rotationally "ahead" of the corresponding exit end 312 in the clockwise direction; similarly, the entrance end 310 of the second retention structure 252*b* is rotationally "ahead" of the corresponding exit end 312 in the clockwise direction. Thus, the capture region 314 associated with each of the retention structures 252*a*, 252*b* may taper in the clockwise direction. The entrance end 310 of each retention structure 252*a*, 252*b* can define a recess or chamfer to further promote initial directing of a body into the corresponding capture region 314. The alignment surface 324 of each retention structure 252*a*, 252*b* can be substantially planar as shown, generally tangent to a circumference of the spout 72; in other embodiments, the alignment surface 324 can have an arcuate or irregular shape.

Sealing features can be provided on or with the spout 72 for effectuating a liquid tight seal with a component inserted over the spout, such as an optional annular sealing rib 340 and/or an optional spout sealing surface 342 (e.g., a chamfered or sloped surface at a leading end 344 of the spout 72).

The adapter 902 and the second connection format 976, including the manner in which they connect to the first connector format 874, correspond the adapter 54 and the second connector format 76 shown and described in FIGS. 15A-19D of US2017/0203887 and the description therein associated with those figures.

As shown, the second connection format 976 is configured to selectively mate with features of the first connection format 874 as described above, and in some embodiments is provided as part of the adaptor 902. With reference to FIGS. 20-37, in addition to the second connection format 976, the adaptor 902 generally includes a tubular member 350. The tubular member 350 can assume various forms, and defines a central passageway 352. The passageway 352 is open at a leading end 354 of the tubular member 350. Further, the tubular member 350 forms or provides mounting features that facilitate assembly to an external liquid source. For example, exterior threads 356 can be provided along an exterior of the tubular member 350 adjacent the leading end 354, configured to threadably interface with threads provided with a hose of an external liquid source. In this regard, a pitch, profile and spacing of the exterior threads 356 can be selected in accordance with the specific thread pattern associated with the make/model of the external liquid source with which the adaptor 902 is intended for use. Other mounting features are equally acceptable that may or may not include or require the exterior threads 356. The tubular member 350 can optionally further include or define a grasping section 358. The grasping section 358 is configured to facilitate user manipulation of the adaptor 54 with a conventional tool, and in some embodiments includes or defines a hexagonal surface pattern adapted to be readily engaged by a wrench. In other embodiments, the grasping section 358 can be omitted.

The second connection format 976 includes a base 360, a first lock structure 362*a*, a second lock structure 362*b*, and a tracking face 364. The base 360 projects from the tubular member 350 and carries or forms the lock structures 362*a*, 362*b* and the tracking face 364. The lock structures 362*a*, 362*b*, in turn, are configured to selectively interface with corresponding ones of the retention structures 252*a*, 252*b*, and the tracking face 364 is configured to interface with the guide surface 260 as described elsewhere.

The base 360 includes a shoulder 370 and a ring 372. The shoulder 370 and the ring 372 combine to define a chamber 374 that is open to the passageway 352 of the tubular member 350 and that is configured to receive the spout 72. The shoulder 370 extends radially outwardly and downwardly from the tubular member 350. The ring 372 projects longitudinally from an outer perimeter of the shoulder 370 in a direction opposite the tubular member 350 and terminates at the tracking face 364. Further, the ring 372 defines a cylindrical inner face 380 opposite an outer face 382. An inner diameter of the ring 372 (e.g., a diameter defined by the cylindrical inner face 380) corresponds with (e.g., approximates or is slightly greater than) an outer diameter of the spout 72. In some embodiments, the ring 372 can define or provide an adaptor sealing surface 384 along the inner face 380 that corresponds with the spout sealing surface 342. An outer diameter of the ring 372 can vary in extension to the tracking face 364 as described below or can be uniform. Regardless, a maximum outer diameter of the ring 372 (e.g., a maximum diameter defined by the outer face 382) is selected to nest within a clearance diameter collectively established by the retention structures 252*a*, 252*b* as described elsewhere.

Geometries of a shape of the tracking face 364 are commensurate with those described above with respect to the guide surface 260. The tracking face 364 can be viewed as providing or generating first and second track segments 390*a*, 390*b* separated by first and second undercuts or trapping regions 392*a*, 392*b*. The circumferential location and shape of the undercuts 392*a*, 392*b* correspond with the undercuts 264*a*, 264*b* in liquid connector 104 of the liquid spray gun nozzle assembly 100 as described above. The shape and geometry of the track segments 390*a*, 390*b* corresponds with the guide segments 262*a*, 262*b* as described above. Thus, for example, the track segments 390*a*, 390*b* can each be viewed as generating a lead-in region 394 and a ramp region 396. A shape of the undercuts 392*a*, 392*b* establishes a finger or retention feature 400 at the transition between the track segments 390*a*, 390*b*. For example, the finger 400 defined at the second undercut 392*b* extends between a leading end 402 of the second track segment 390*b* and a trailing end 404 of the first track segment 390*a*.

In some embodiments, the lock structures 362*a*, 362*b* are identical, such that the following description of the first lock structure 362*a* applies equally to the second lock structure 362*b*. The lock structure 362*a* defines a first end 420 opposite a second end 422 in circumferential extension along the ring 372. Further, projection of the lock structure 362*a* from the ring 372 defines or forms an abutment face 424 opposite an upper face 426, along with a guide face 428. A shape of the abutment face 424 follows or is contiguous with the corresponding portions of the tracking face 364. For example, at the first end 420, the abutment face 424 intersects the first track segment 390*a* intermediate the ramp region 396. In extension from the first end 420, a shape of the abutment face 424 mimics or follows the angled or partial helix orientation of the ramp region 396; further, a shape of the abutment face 424 mimics or follows the substantially flat or planar shape of the lead-in region 394 to the second end 422.

The upper face 426 is formed longitudinally opposite the abutment face 424 to define a height of the lock structure 362*a*. In some embodiments, a plane or shape of the upper face 426 varies between the first and second ends 420, 422, forming the lock structure 362*a* to provide an insertion section 440, a locking section 442 and an optional tail section 444. The insertion section 440 can include the major plane of the upper face 426 being non-parallel with the major plane of the corresponding region of the abutment face 424 such that lock structure 362*a* has a reduced height at the first end 420. Stated otherwise, the height of the lock structure 362*a* can increase along the insertion section 440 in extension from the first end 420. In some embodiments, a chamfer can be formed in the upper face 426 at the first end 420, and a remaining portion of the upper face 426 along the insertion section 440 is substantially flat or planar, arranged to be non-parallel with the abutment face 424. The upper face 426 is generally parallel with corresponding region of the abutment face 424 along the locking section 442, and generates a shape or geometry relative to the ring 372 akin to a partial helix. The tail section 444 can include the abutment and upper faces 424, 426 being substantially parallel in extension to the second end 422. With this construction, a vertical location of the lock structure 362*a* relative to the central axis A changes as the lock structure 362*a* revolves about the ring 372, with the first end 420 being vertically "above" the second end 422 relative to the upright orientation of, e.g., FIG. 31.

A radial width of the lock structure 362*a* is defined by a radial (relative to the central axis A) distance between the ring 372 and the guide face 428. With this in mind, the lock structure 362*a* can have a varying or non-uniform radial width relative to the central axis A. For example, a shape of the guide face 428 (relative to the top plan view of FIG. 32) can define a uniform or slightly increasing radius in extension from the first end 420, and a tapering or decreasing radius to the second end 422 creating a streamlined appearance.

In some embodiments, a shape of the lock structure 362*a* is further demarcated from, and more precisely formed relative to, the ring 372 by an inset or depression formed in a face of the ring 372 adjacent the lock structure 362*a*, as well as an optional groove 452 as identified in FIG. 15A of US2017/0203887. Regardless, the lock structures 362*a*, 362*b* are arranged about the ring 372 such that the spatial features are in the same rotational direction relative to the central axis A. For example, the vertically higher first end 420 of each lock structure 362*a*, 362*b* is rotationally "ahead" of the corresponding, vertically lower second end 422 in the clockwise direction.

In some embodiments, the adaptor 902 is formed of a rigid material, such as stainless steel (303 S31). Other materials, such as plastic, are also envisioned. Composites or other materials for use with particular coating materials and/or applications are also acceptable.

Figure 20:
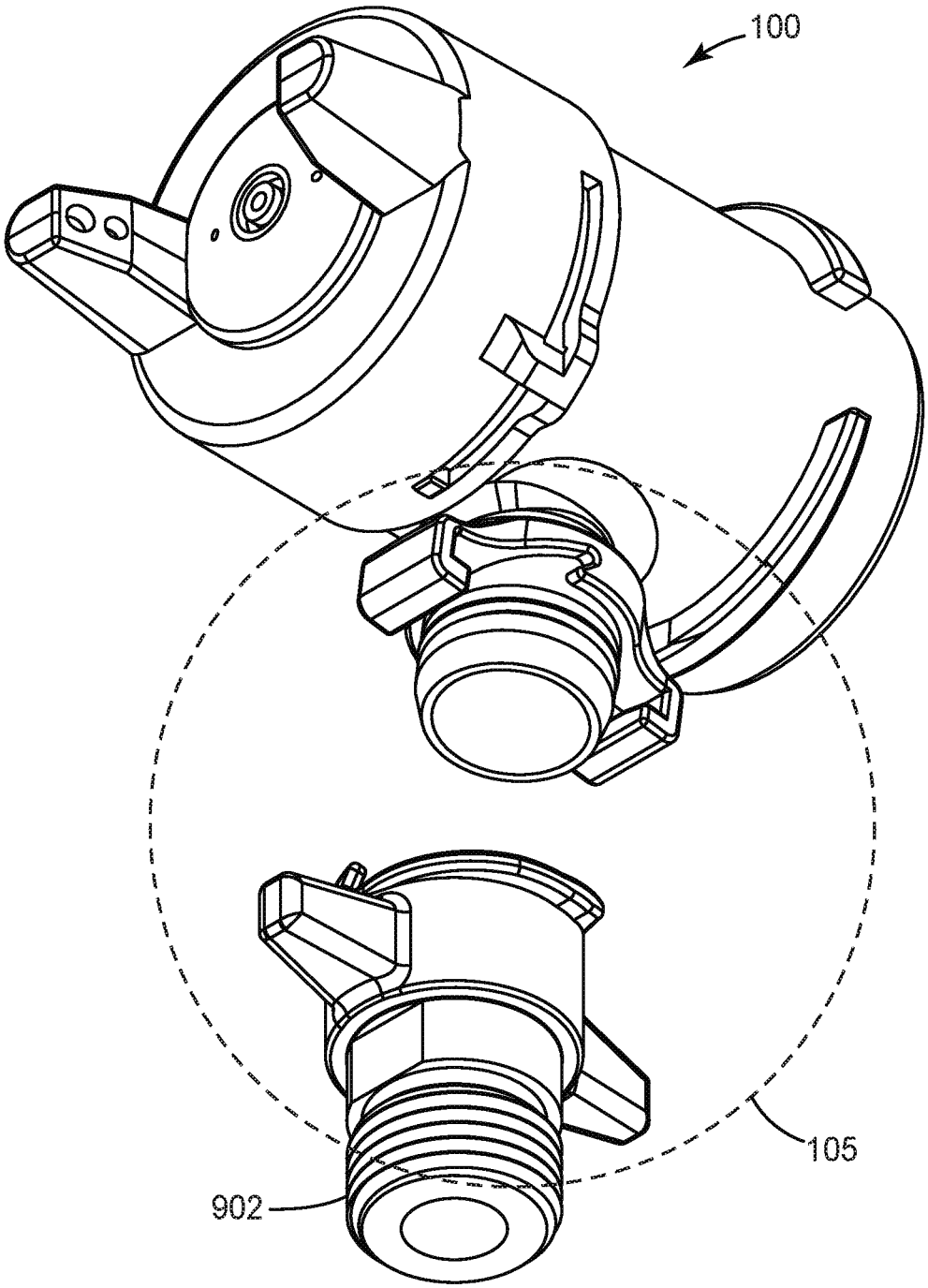
FIG. 20 depicts an exemplary liquid spray gun nozzle assembly with an adapter in an unassembled state according to the present disclosure.
Figure 21:
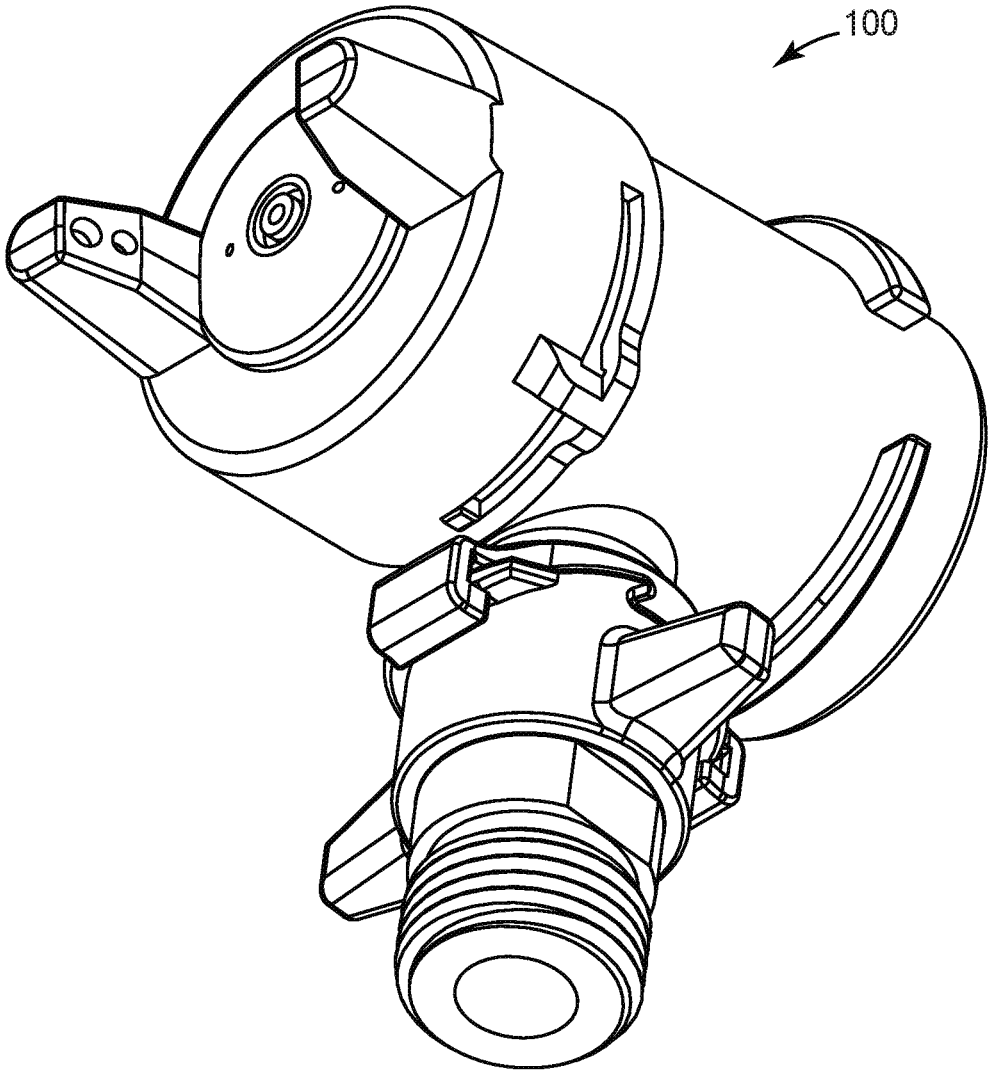
FIG. 21 depicts an exemplary liquid spray gun nozzle assembly with an adapter in an assembled state according to the present disclosure.
Figure 24:
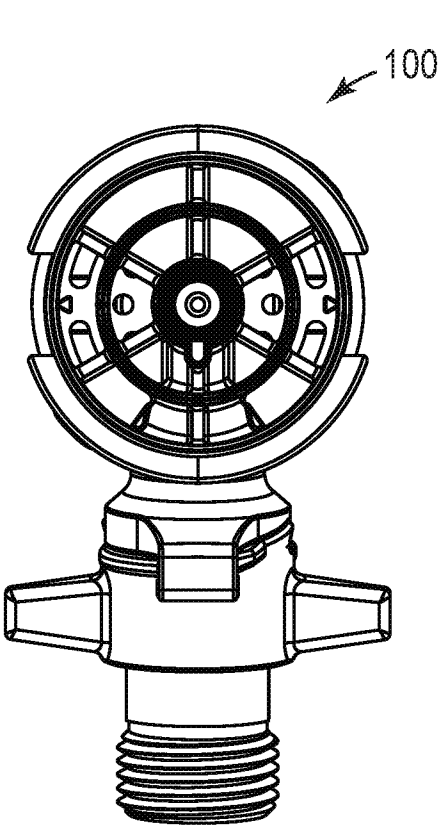
FIG. 24 is a rear view of the assembly of FIG. 21.
Figure 23:
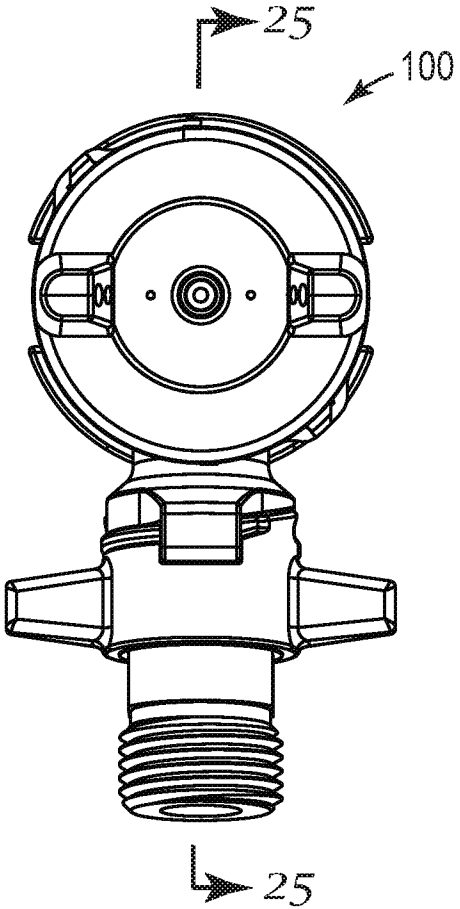
FIG. 23 is a front view of the assembly of FIG. 21.
Figure 22:
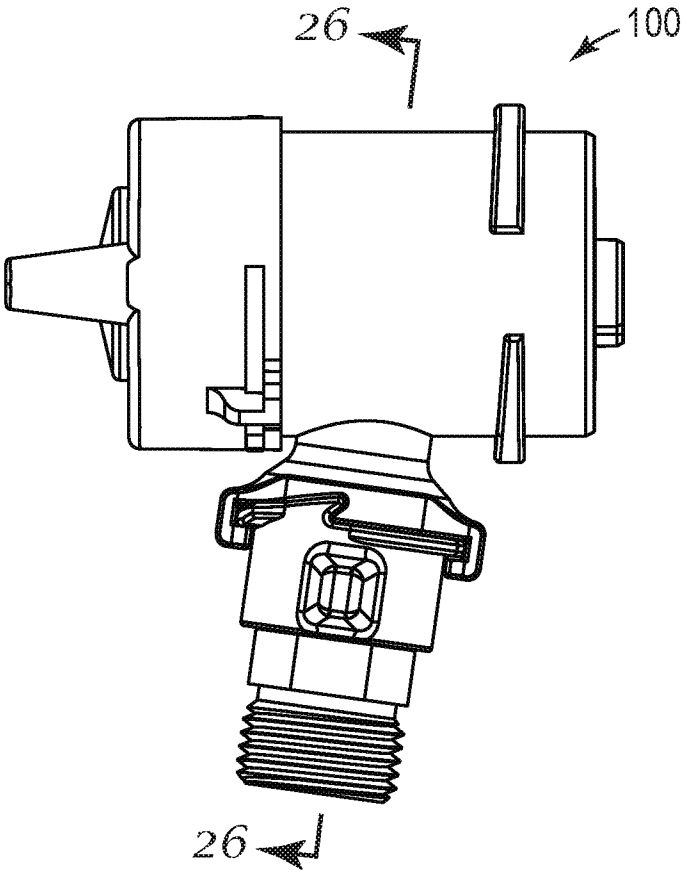
FIG. 22 is a right side view of the assembly of FIG. 21.
Figure 26:
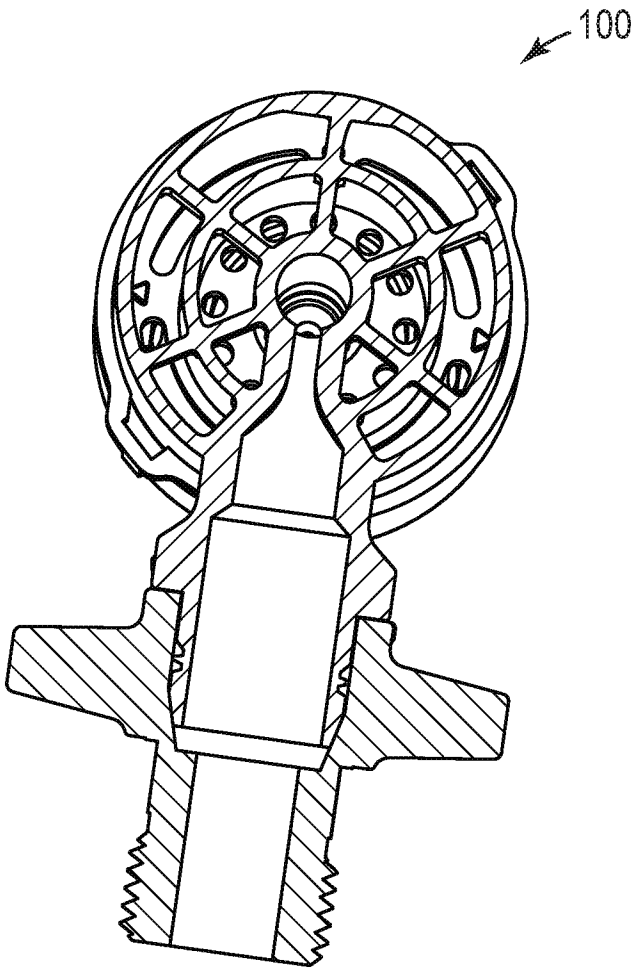
FIG. 26 is a cross-section view of the assembly of FIG. 21 taken at 26-26 of FIG. 22.
Figure 25:
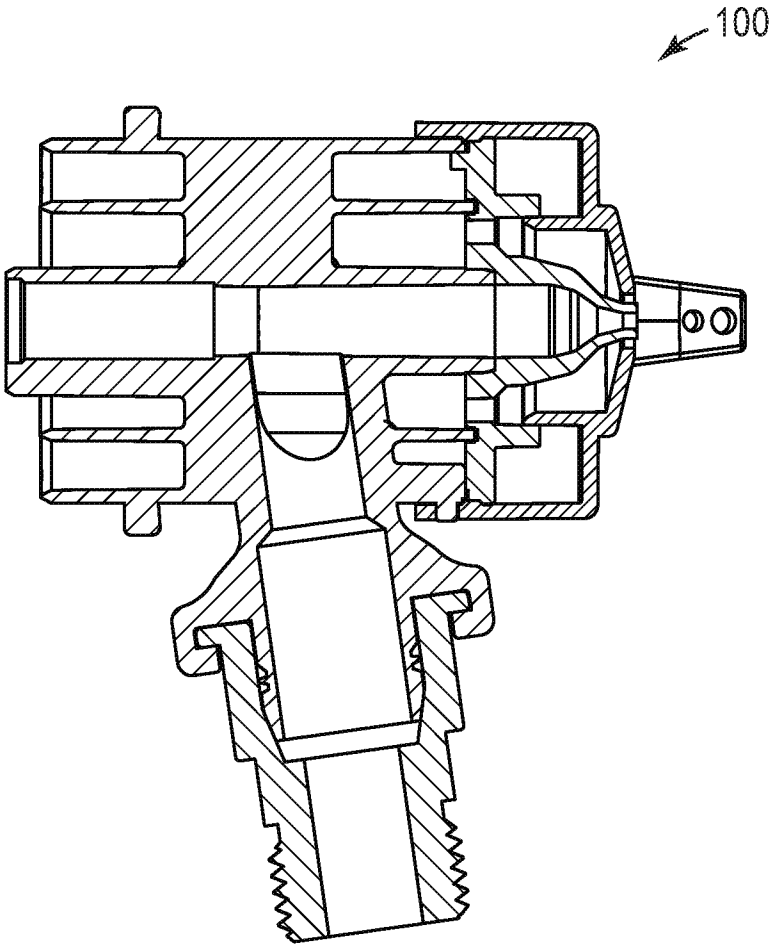
FIG. 25 is a cross-section view of the assembly of FIG. 21 taken at 25-25 of FIG. 23.
Figure 27:
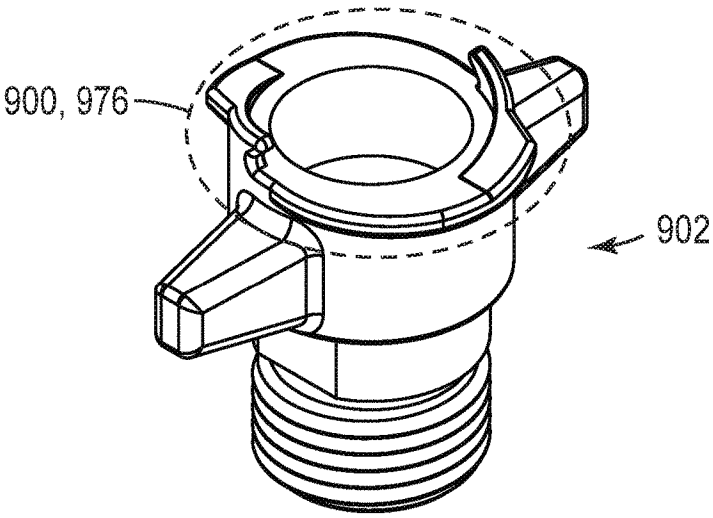
FIGS. 27-31 are isometric views of an exemplary adapter according to the present disclosure.
Figure 28:
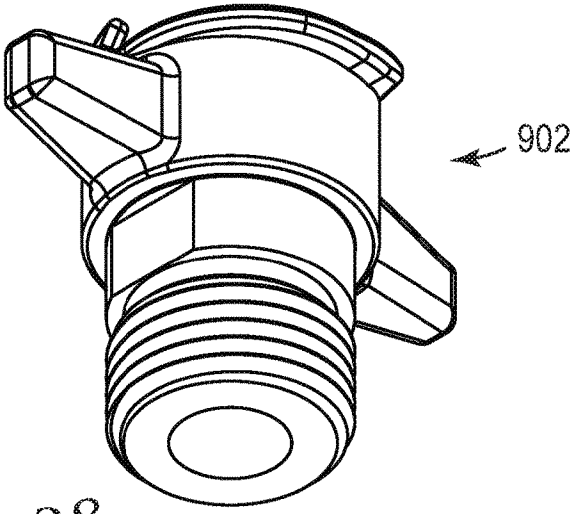
Figure 29:
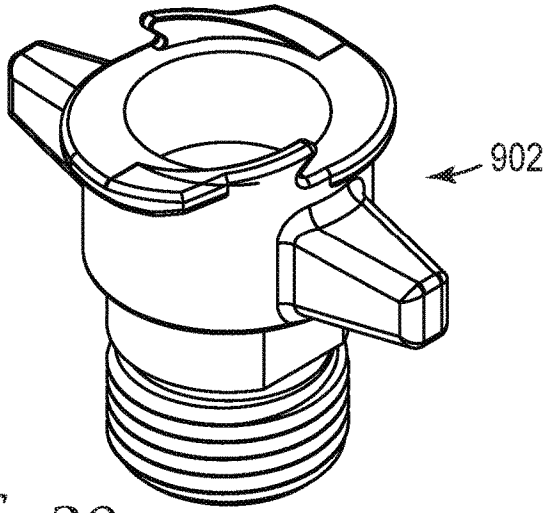
Figure 30:
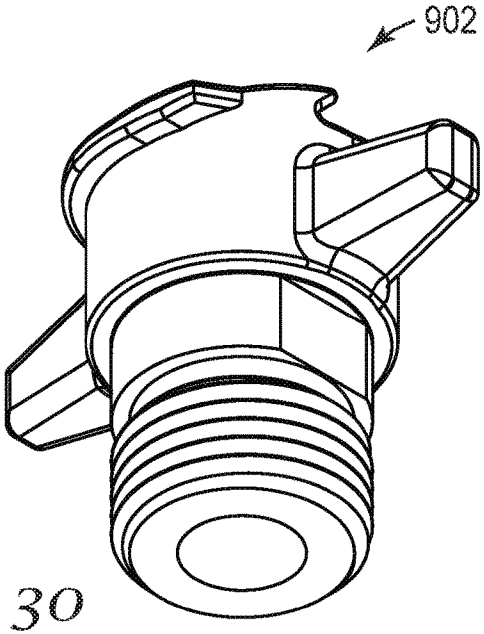
Figure 31:
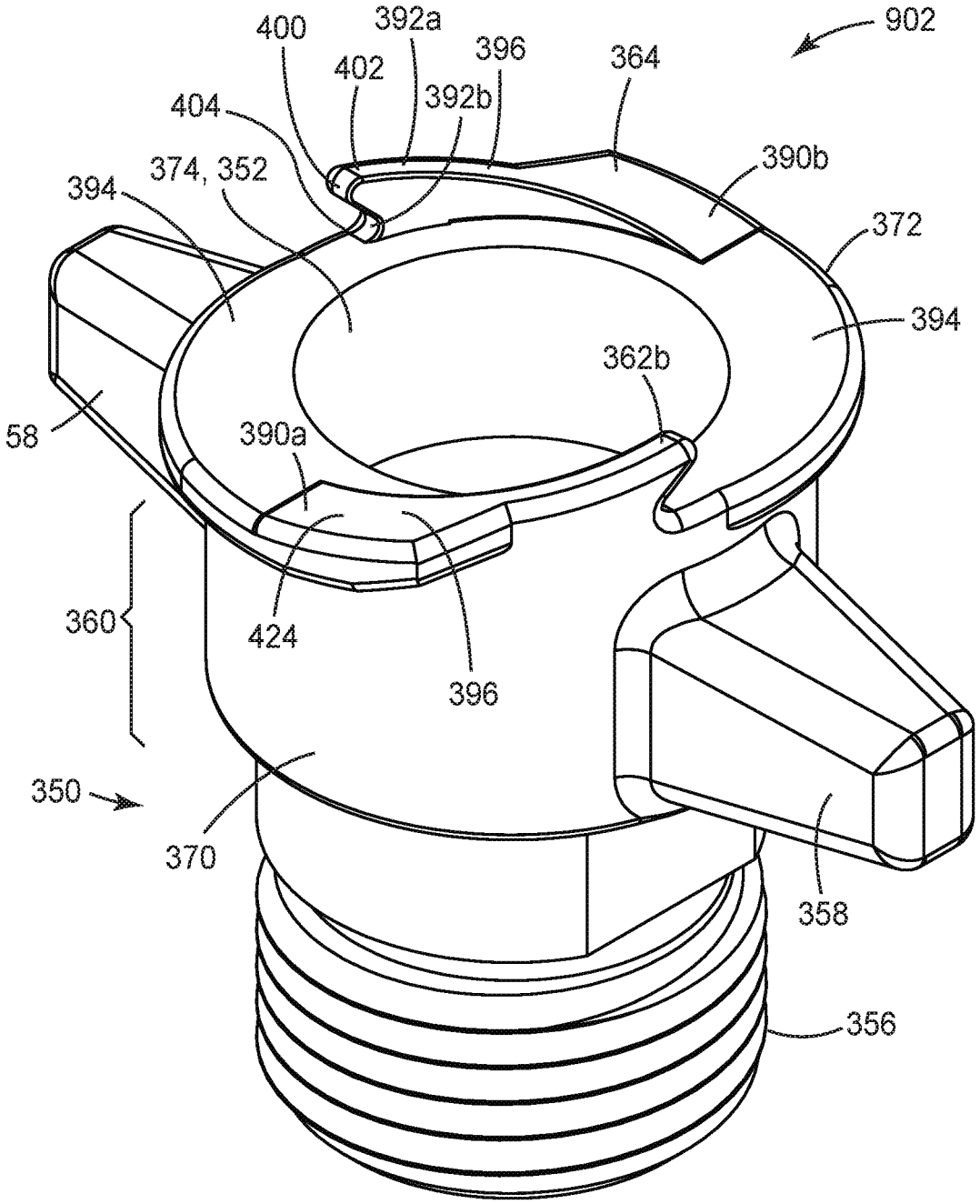
Figure 32:
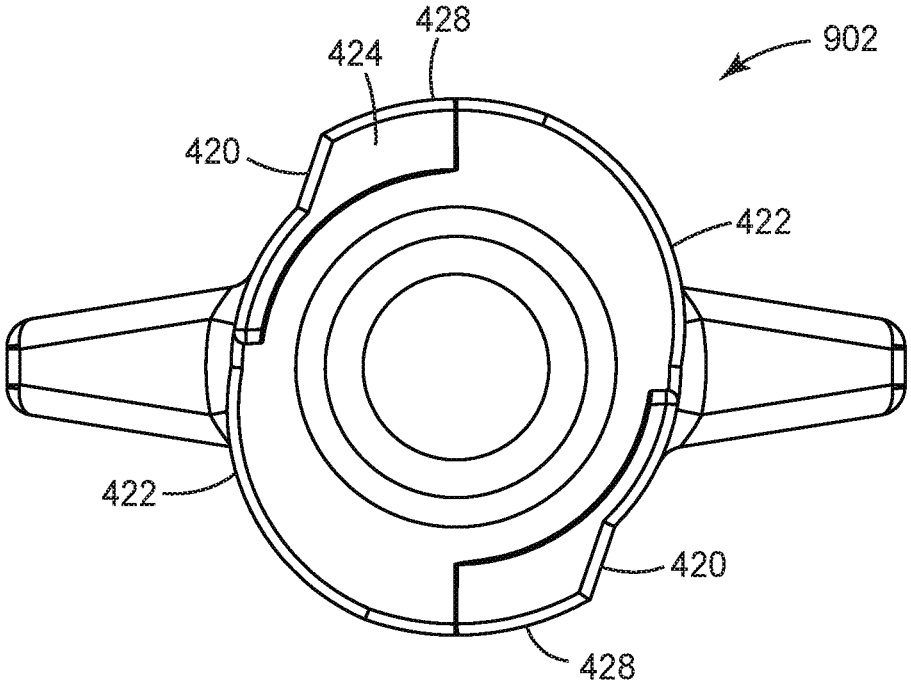
FIG. 32 is a top view of the adapter of FIG. 27.
Figure 33:
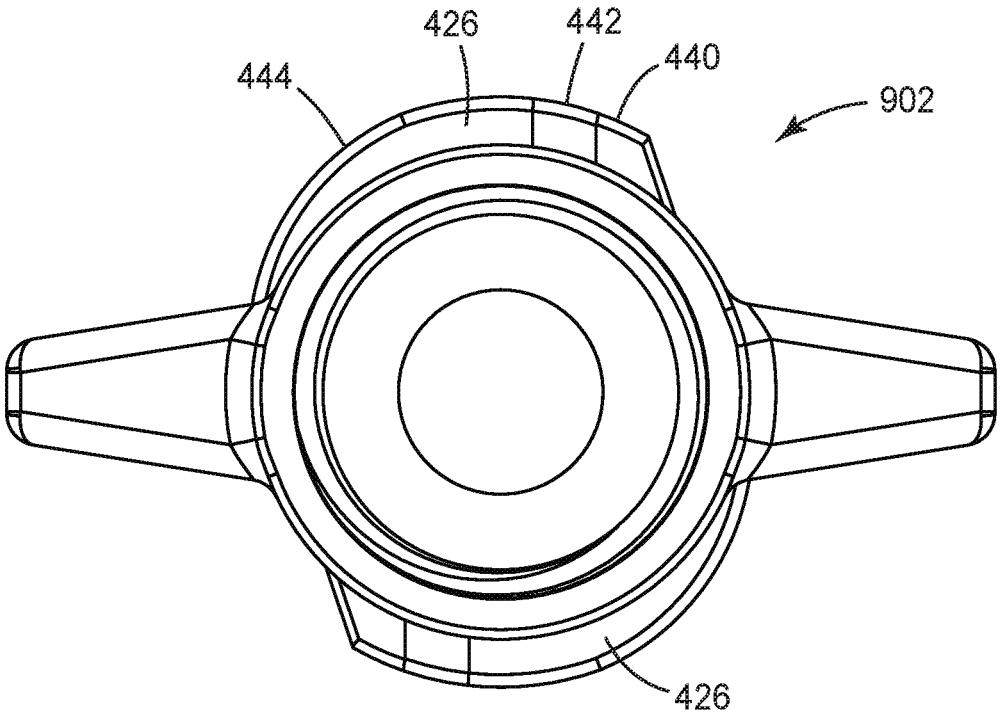
FIG. 33 is a bottom view of the adapter of FIG. 27.
Figure 34:
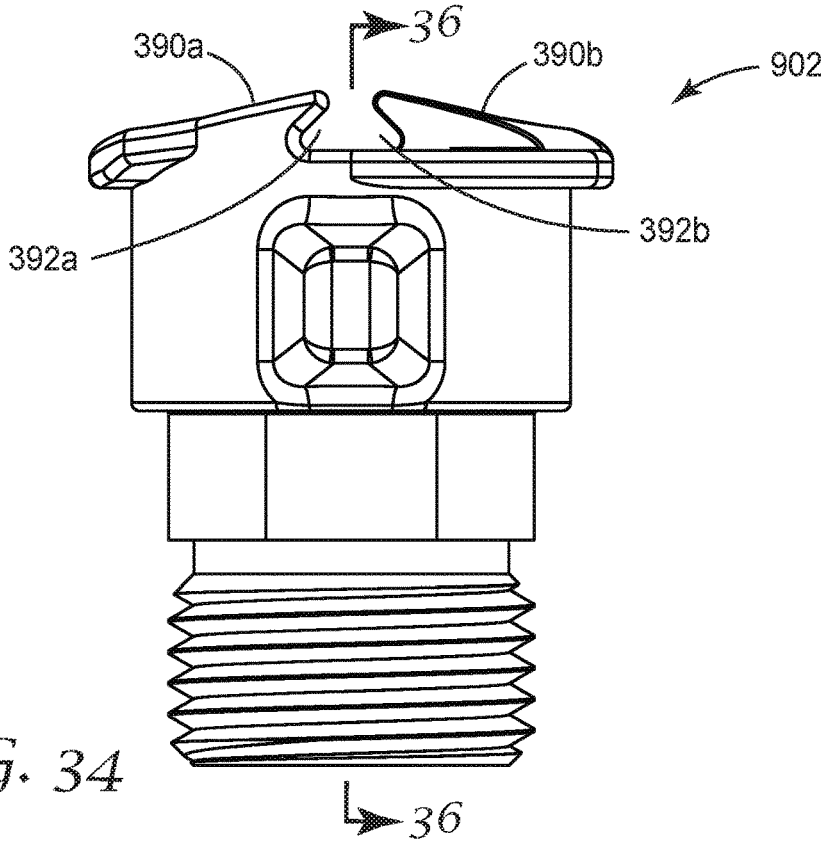
FIG. 34 is a right side view of the adapter of FIG. 27 (the left side view is a mirror image of the right side view, and is therefore not shown)
Figure 35:
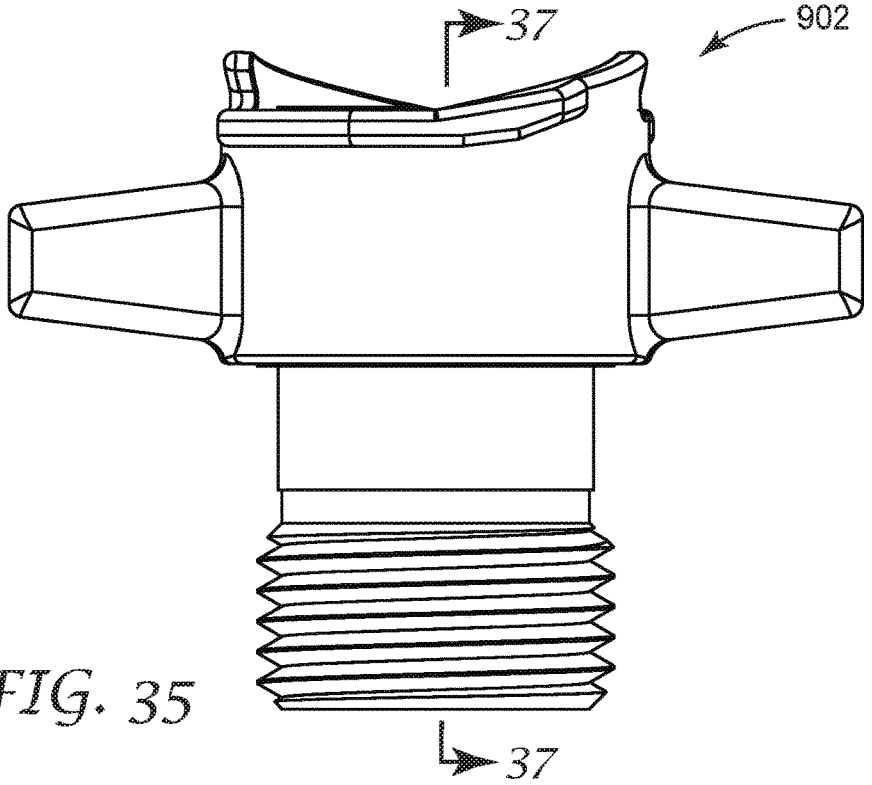
FIG. 35 is a front view of the adapter of FIG. 27 (the rear view is a mirror image of the front view, and is therefore not shown)
Figure 36:
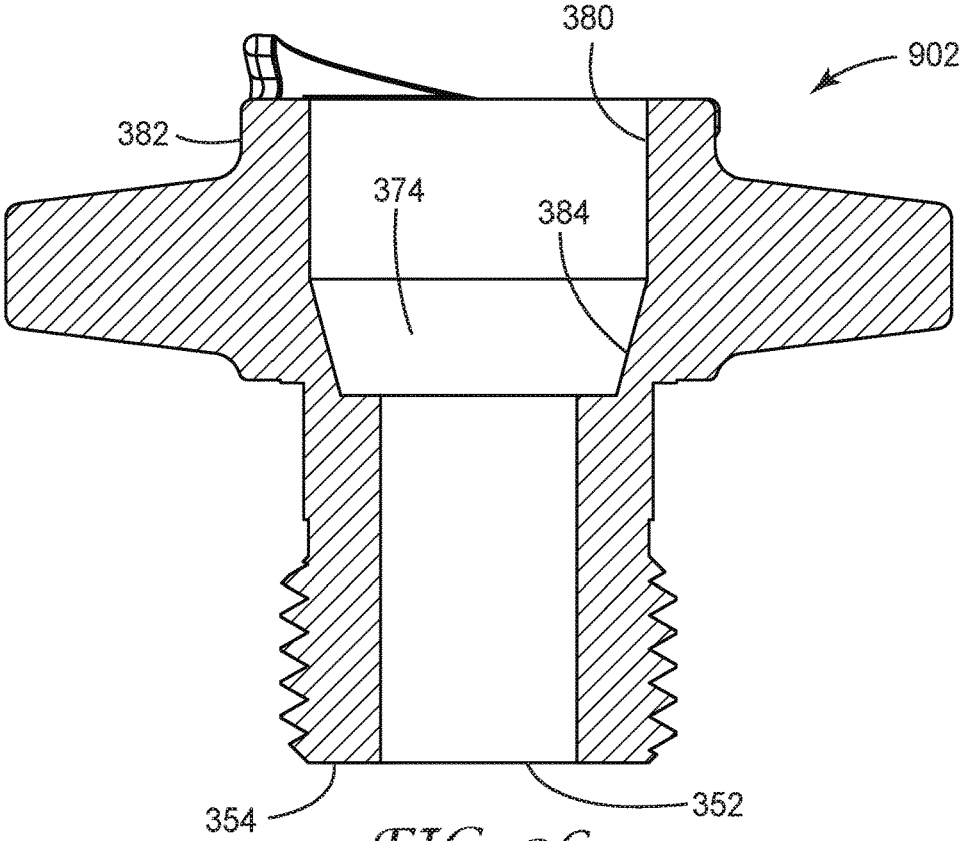
FIG. 36 is a cross-section view of the adapter of FIG. 27 taken at 36-36 of FIG. 34.
Figure 37:
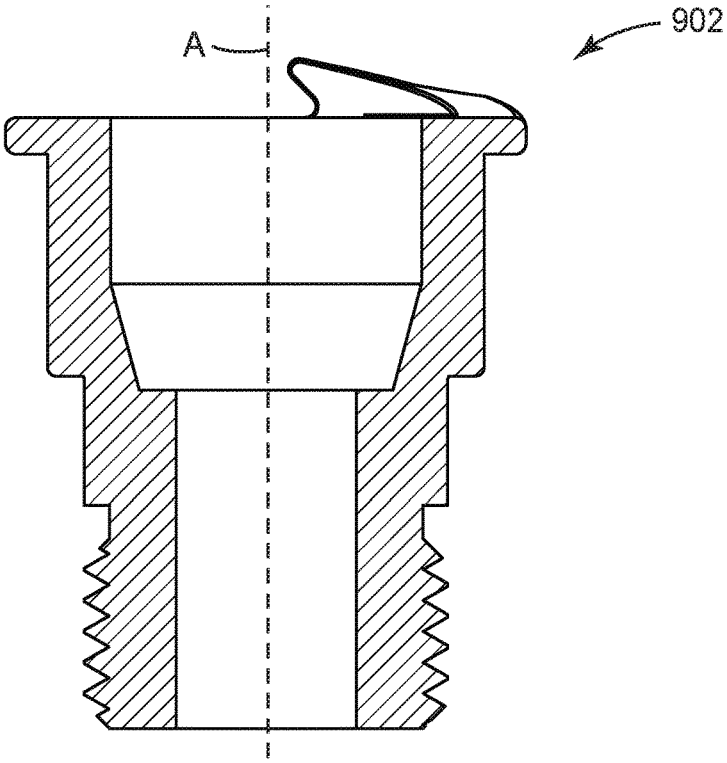
FIG. 37 is a cross-section view of the adapter of FIG. 27 taken at 37-37 of FIG. 35.

Coupling of the liquid spray gun nozzle assembly 100 and the adaptor 902 begins with alignment of the ring 372 with the spout 72 as shown generally in FIG. 20. In the arrangement of FIG. 20, the adaptor 902 is rotationally arranged such that the lock structures 362*a*, 362*b* are rotationally off-set from the retention structures 252*a*, 252*b*. The adaptor 902 is then directed on to the liquid spray gun nozzle assembly 100 (and/or vice-versa), with the spout 72 nesting within the base 360.

In an initial assembly state (as correspondingly indicated, for example, in FIGS. 17A and 17B of US2017/0203887), the adaptor 902 is placed on to the liquid spray gun nozzle assembly 100 as described above, with the lock structures 362*a*, 362*b* being rotationally spaced from the retention structures 252*a*, 252*b*. FIG. 17C of US2017/0203887 further exemplifies what would be the rotational arrangement of the adaptor 902 relative to the liquid spray gun nozzle assembly 100 upon initial placement. Relative to a clockwise direction, the first end 420 of the first lock structure 362*a* is "ahead" of the entrance end 310 of the first retention structure 252*a*, and the first end 420 of the second lock structure 362*b* is "ahead" of the entrance end 310 of the second retention structure 252*b*. The enlarged radial width of the lock structures 362*a*, 362*b* encourages a user to initially place the adaptor 902 on to the liquid spray gun nozzle assembly 100 in the rotational position shown in FIG. 20. Sections of the tracking face 364 of the adaptor 902 bear against the guide surface 260 of the liquid spray gun nozzle assembly 100. For example, a portion of the ramp region 396 of the first track segment 390*a* bears against the ramp region 268 of the first guide segment 262*a*. Due to the partial helix shape along the guide segments 262*a*, 262*b* of the liquid connector 104 of the liquid spray gun nozzle assembly 100 and along the track segments 390*a*, 390*b* of the adaptor 902 as described above, in this initial state of contact between the adaptor 902 and the liquid spray gun nozzle assembly 100, the lock structures 362*a*, 362*b* are located vertically "below" the capture region 314 of each of the retention structures 252*a*, 252*b* (relative to the orientation of FIG. 20).

The adaptor 902 is then rotated relative to the liquid spray gun nozzle assembly 100 (and/or vice-versa), directing each of the lock structures 362*a*, 362*b* into engagement with corresponding ones of the retention structures 252*a*, 252*b*. For example, and with reference to the first retention structure 252*a* and the first lock structure 362*a*, the adaptor 902 can be rotated (e.g., clockwise) such that the first end 420 of the first lock structure 362*a* approaches and then enters the capture region 314 at the entrance end 310 of the first retention structure 252*a*. Due to the sliding interface between the tracking face 364 of the adaptor 54 and the guide surface 260 of the lid body 70 (e.g., between the ramp region 396 of the first track segment 390*a* and the ramp region 268 of the first guide segment 262*a*) and the corresponding helical-like shapes, as the adaptor 902 is rotated, the adaptor 902 vertically rises relative to the retention structures 252*a*, 252*b* such that as the first lock structure 362*a* nears the entrance end 310 of the first retention structure 252*a*, the first end 420 of the first lock structure 262*a* comes into alignment with the capture region 314 at the entrance end 310. For example, FIGS. 18A-18C of US2017/0203887 illustrate a later stage of rotation of the adaptor 54 relative to the lid body 70, which would correspond to the presently described adapter 902 and liquid spray gun nozzle assembly 100. As correspondingly shown in the cross-section of FIG. 18C, the first end 420 of the first lock structure 362*a* has entered the capture region 314 of the first retention structure 252*a*. In this regard, due to the reduced height of the first end 420 of the lock structure 362*a* and the increased height of the capture region 314 at the entrance end 310 as described above, the lock structure 362*a* readily directed into the capture region 314 with minimal interference between the upper face 426 of the lock structure 362*a* and the engagement surface 322 of the retention structure tab 302.

With continued rotation of the adaptor 902 relative to the liquid spray gun nozzle assembly 100 (and/or vice-versa), each lock structure 362*a*, 362*b* will become frictionally and mechanically locked within the capture region 314 of a respective one of the retention structures 252*a*, 252*b*. FIGS. 21-26 illustrate a locked state of the liquid spray gun nozzle assembly 100 and the adaptor 902. The tracking face 364 (referenced generally) of the adapter 902 has further rotated relative to and along the guide surface 260, achieving more complete engagement of the lock structures 362*a*, 362*b* within a corresponding one of the retention structures 252*a*, 252*b*. Further, the undercuts 392*a*, 392*b* of the adaptor 902 have been brought into meshed engagement with the undercuts 264*a*, 264*b* of the first connector format 874. For example, in the view of FIG. 22, an abutting interface is achieved between the finger 400 of the adaptor second undercut 392*b* against the shoulder 290 of the lid body first undercut 264*a*. This interface prevents over rotation of the adaptor 902 relative to the liquid spray gun nozzle assembly 100 (and/or vice-versa) and serves to stabilize the connection assembly.

By way of illustration, the cross-sectional view of FIG. 19D of US2017/0203887 illustrates a corresponding first lock structure 362*a* lodged within a capture region 314 (referenced generally) of the first retention structure 252*a*, and reflects that a shape and spatial orientation of the locking section 442 mimics that of the capture region 314 along the wedging section 330. In the locked state, the abutment face 424 of the lock structure 362*a* bears against the lead-in region 266 of the lid body guide surface 260, and the locking section 442 of the upper face 426 of the lock structure 362*a* can bear against a wedging section 330 (as shown in US2017/0203887) of the engagement surface 322 of the tab 302. The downward angular orientation of the guide and engagement surfaces 260, 322, and of the abutment and upper faces 424, 426 along the wedging section 330, relative to a plane perpendicular to the axis of rotation dictates that as the lock structure 362*a* progressively advances through the capture region 314 (i.e., the first end 420 of the lock structure 362*a* is progressively advanced from the entrance end 310 of the retention structure 252*a*), the adaptor 902 is pulled or drawn upwardly (relative to the orientation of FIG. 20) on to the liquid spray gun nozzle assembly 100, promoting a liquid-tight seal between the components. For example, in some non-limiting embodiments, a seal can be established between the annular sealing rib 340 of the spout 72 with inner face 380 of the adaptor 902, between the spout sealing surface 342 and the adaptor sealing surface 384, etc. The spout sealing surface 342 and the adaptor sealing surface 384 have a complementary configuration, designed to interfere and seal when the system is locked. The expanding height of the capture region 314 along the clearance section 332 to the exit end 312 readily allows passage of the first end 420 for ease of assembly.

In other embodiments, the connector formats can be swapped so that so that the geometry described for the liquid spray nozzle assembly 100 is on the adapter 902, and vice versa.

Figure 15:
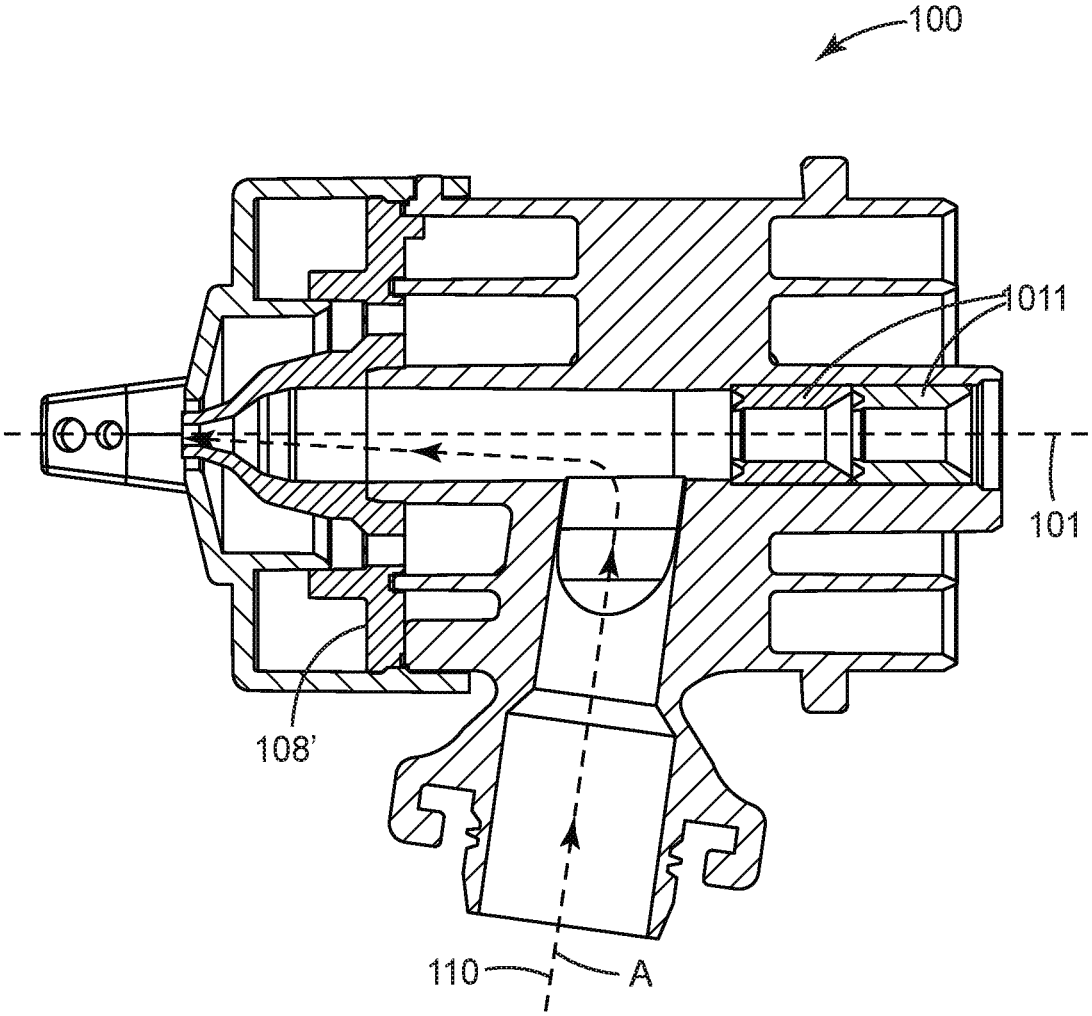
FIG. 15 is a cross-section view thereof taken at 15-15 of FIG. 9.
Figure 16:
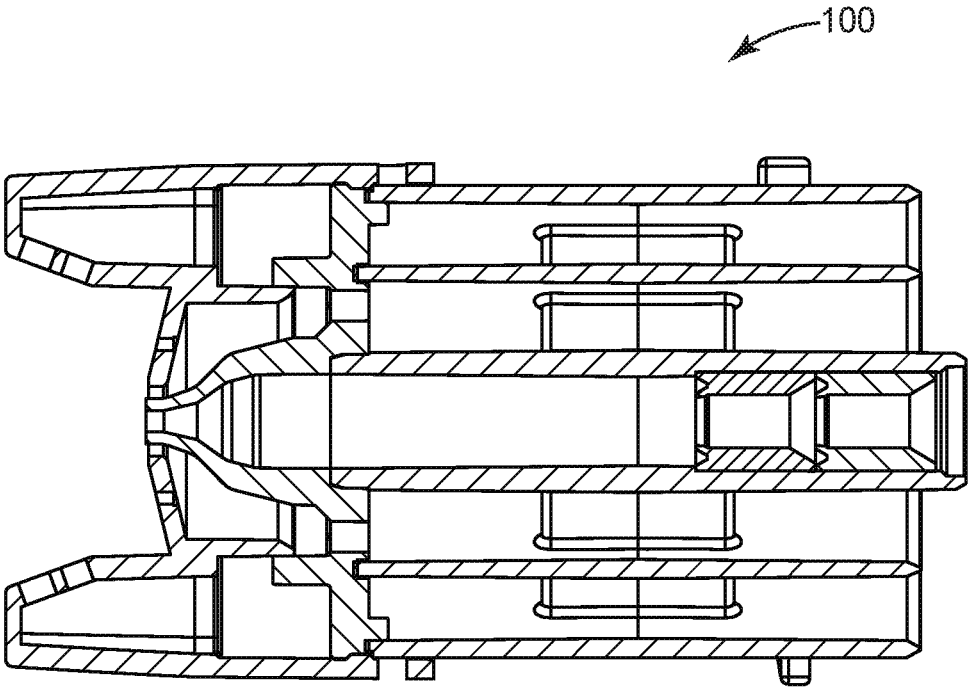
FIG. 16 is a cross-section view thereof taken at 16-16 of FIG. 9.

Within the liquid spray gun nozzle assembly 100 is a coating liquid flow path 110 through which the coating liquid flows from the liquid spray gun coating liquid connector 104 to a liquid nozzle 108 (see, e.g., FIG. 15). In operation, the coating liquid passes from the coating liquid inlet portion 102, along the coating liquid flow path 110, along a spray axis 101 parallel to a liquid needle 9', and ultimately is expelled from the liquid nozzle 108 upon depressing the trigger 5. When the spray gun is idle (i.e., not spraying), the liquid needle 9' typically occludes the liquid nozzle 108. The liquid needle is sealed by one or more liquid needle sealing elements 111 towards the rearward end of the coating liquid flow path 110 (as seen, for example, in FIGS. 15-17, wherein the liquid needle 109 is not shown as the exemplary liquid spray gun nozzle assembly 100 is shown in a detached state). When the trigger 5 is depressed, the liquid needle 9' is withdrawn from the liquid nozzle 108, thereby allowing the coating liquid to pass through. At the same time, depressing the trigger activates the pressurized air supply to assist in (depending on the gun type) urging coating liquid through and/or from the liquid nozzle 108, atomizing the coating liquid, or shaping the coating liquid (e.g., via the air cap 115, described below). The travel of liquid needle 9' and the total air flow through the gun is adjusted via the liquid needle adjustment control 9. In the embodiment shown, the relative volume of air-flow among the air cap 115 (for shaping purposes) and a center air outlet 107 (for atomization purposes) is controlled via an air adjustment control 8. The forward end of the nozzle body 100' comprises a nozzle plate 108' which comprises the liquid nozzle 108 along with air guiding apparatus to guide shaping air and atomization air to the shaping air zone 442 and the center air zone 444 (described elsewhere) in the assembled air cap 115. In the embodiments shown, the nozzle plate 108' is optionally provided as a separate part that is sealingly secured to the nozzle body 100' by means of an adhesive, welding, or the like. In other embodiments, the nozzle plate 108' is integral with the nozzle body 100'.

In some embodiments, the liquid spray nozzle assembly comprises an air cap 115 affixed to the spraying end thereof. When provided, an air cap 115 can direct pressurized air advantageously toward the stream of coating liquid, e.g., via one or more shaping air outlets 116 located in one or more air horns 117, as it is expelled from the liquid nozzle 108 to assist in atomization of the coating liquid and shaping of the coating liquid jet into the desired spray pattern for a given application. Within the air cap or proximate the air cap, the center air outlet 107 directs air around the liquid outlet 108 to draw the coating liquid from the liquid nozzle 108 and (if desired) also impinges upon the coating liquid to atomize it, creating a fine mist of droplets. Optionally, one or more auxiliary air outlets 118 may be provided in the air cap 115 to further assist in shaping the spray pattern. The air cap 115, the center air outlet 107, the liquid nozzle 108, the air horns 117, the auxiliary air outlets 118, and the shaping air outlets 116 may be configured as described in U.S. patent application No. 62/430,393, entitled "Spray Gun Air Cap Retention Means," and/or in U.S. Pat. Pub. Nos. 2016/0052003 A1 ("Liquid Spray gun, spray gun platform, and spray head assembly"); 2013/0327850 A1 ("Nozzle tips and spray head assemblies for liquid spray guns"); 2014/0246519 A1 ("Spray head assembly with integrated air cap/nozzle for a liquid spray gun"); 2013/0092760 A1 ("Spray head assemblies for liquid spray guns"); 2015/0069142 A1 ("Spray gun barrel with inseparable nozzle"); 2016/0151797 A1 ("Air caps with face geometry inserts for liquid spray guns"); 2016/0175861 A1 ("Nozzle assemblies, systems and related methods"); and/or in WO2015/191323); and/or WO2016/033415), the disclosures of which are hereby incorporated by reference in their entireties. In the embodiments shown, the coating liquid is contained entirely within the liquid spray gun nozzle assembly 100, thus generally avoiding the need to clean the liquid spray gun body 3 after use.

As described in 62/430,383, the external liquid source 6' may be a container that is directly affixed to the liquid spray gun nozzle assembly 100, or may comprise a remote reservoir that is connected to the liquid spray gun nozzle assembly 100 by way of a hose. In some embodiments, the external liquid source is remotely pressurized (via a pressurized canister, a remote pump, or the like) to force the coating liquid into the liquid spray gun nozzle assembly 100. In other embodiments, the coating liquid may be forced or pulled into the liquid spray gun nozzle assembly 100 under the force of gravity, by way of a negative pressure induced by a venturi at the liquid nozzle 108, by a local pump, or through a combination of the above. Because the external liquid source can vary as described, it is shown in schematic form in FIGS. 1 and 3 of 62/430,383.

As shown in FIGS. 18 and 19 (or in FIGS. 4 and 5 of 62/430,383), a liquid needle 9' is affixed to the liquid spray gun body 3, such that cleaning of the liquid spray gun body 3 is generally limited to wiping or otherwise clearing the tip of the liquid needle after detaching the liquid spray gun nozzle assembly 100. In other embodiments, the liquid needle may be housed in the liquid spray gun nozzle assembly 100 such that it is removable from the liquid spray gun body 3 along with the liquid spray gun nozzle assembly 100. In either case, the liquid spray gun nozzle assembly 100, if disposable, may be discarded after use such that no further cleanup is required. Alternatively, the liquid spray gun nozzle assembly 100, if reusable, is the only portion of the liquid spray gun 2 left to clean. Both configurations can result in reduced cleanup time and materials, such as solvents, compared to what is typically required in a conventional spray gun.

Figure 4:
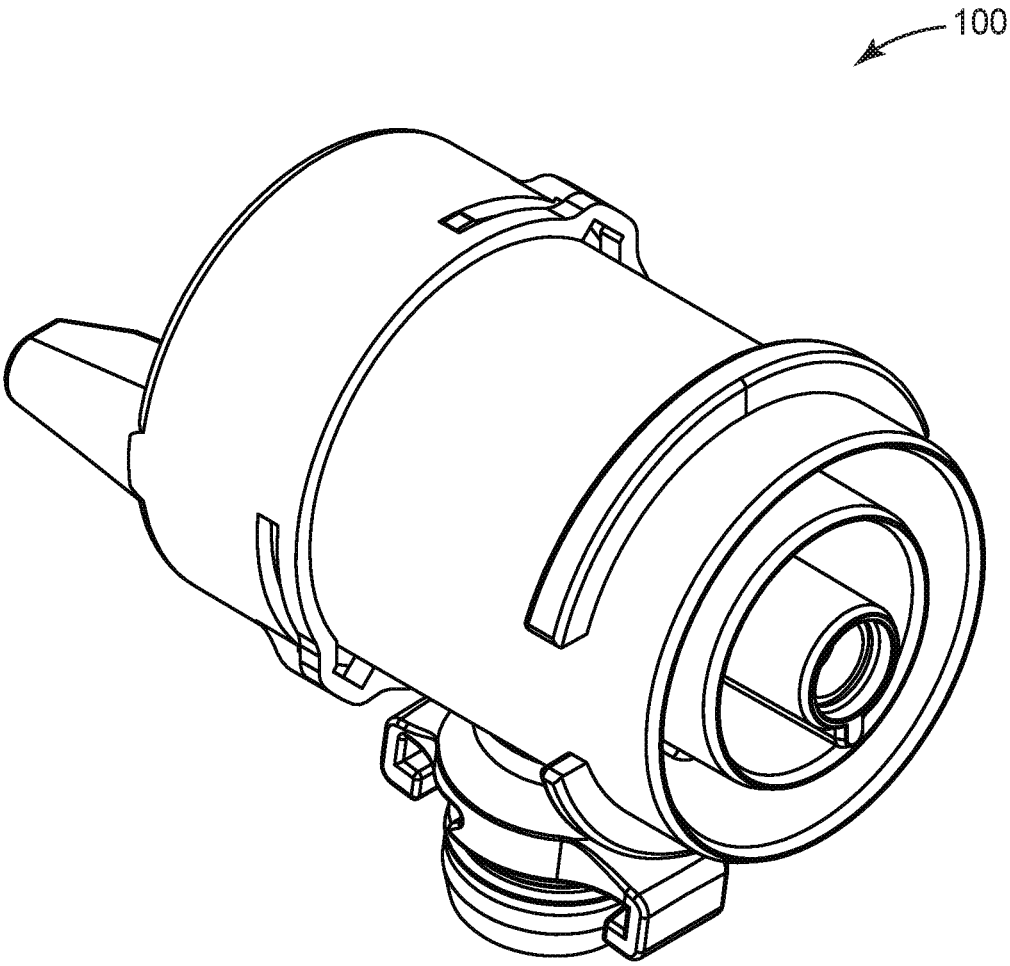
Figure 5:
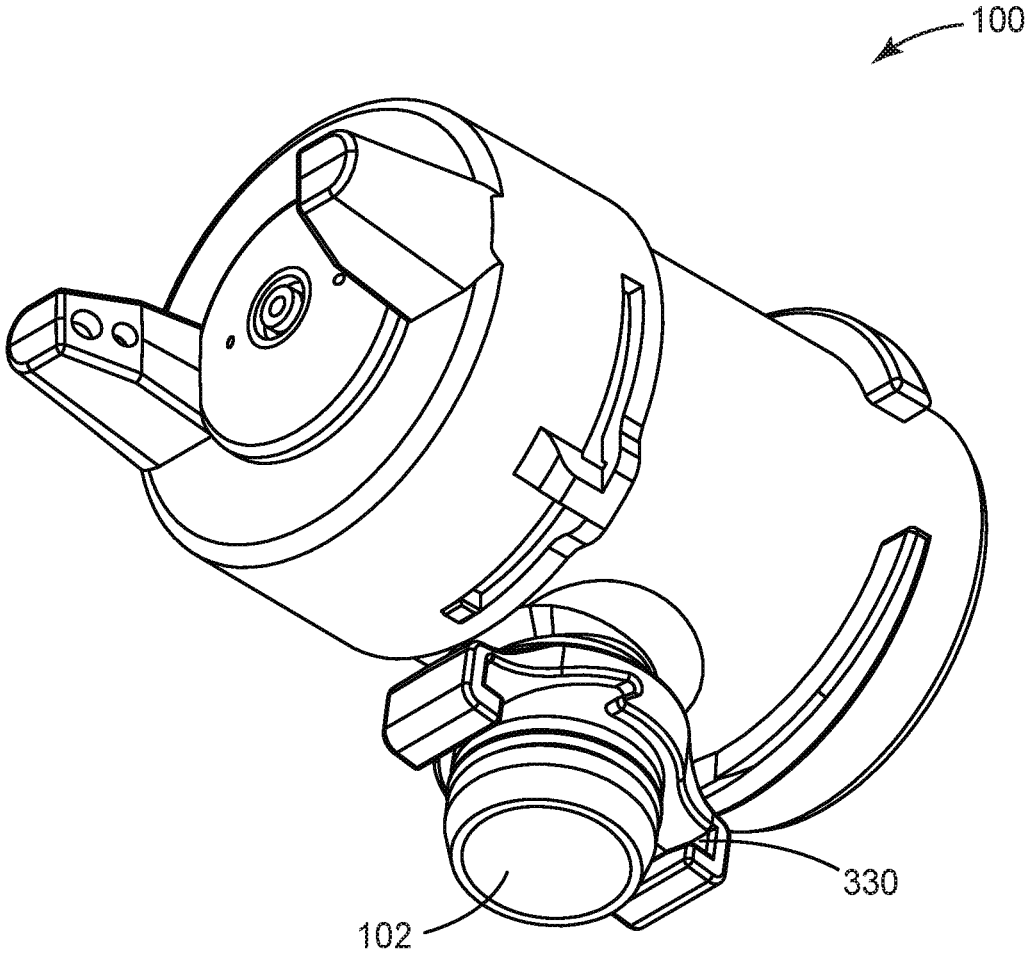
Figure 6:
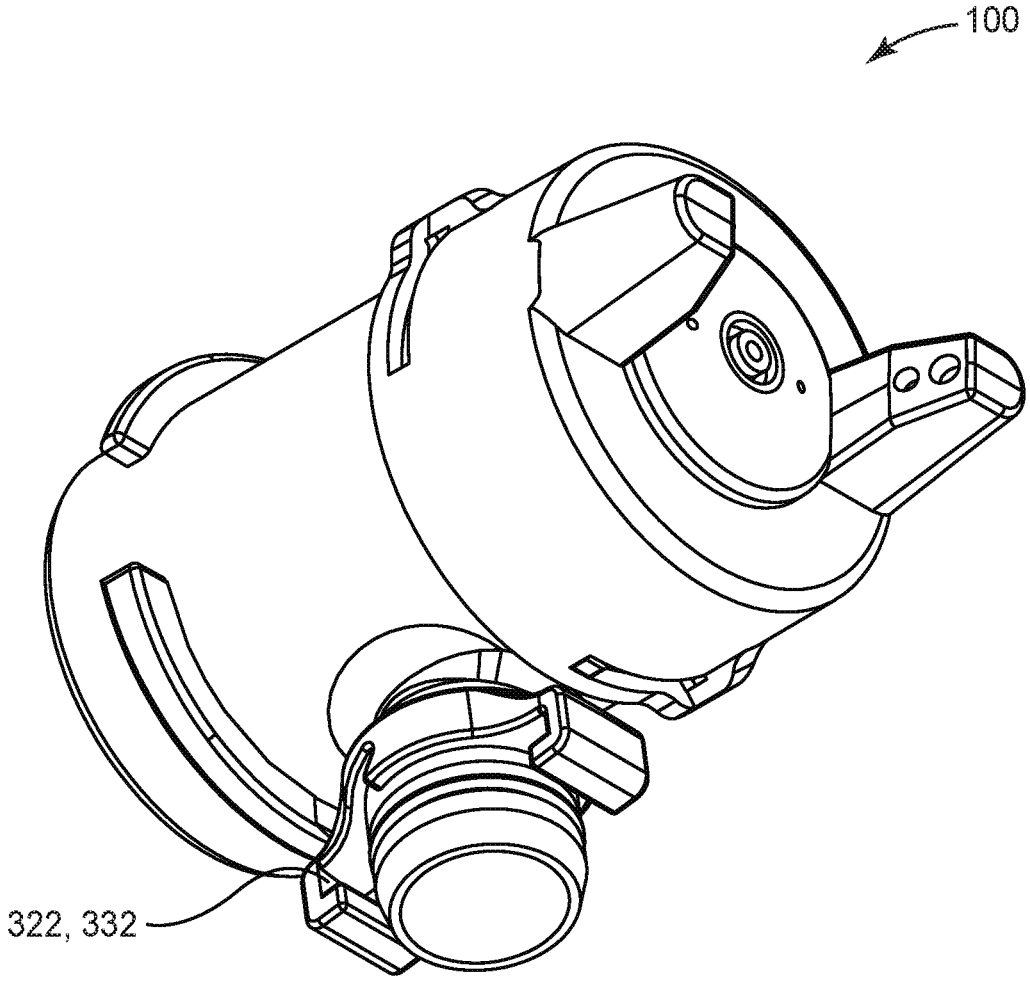
Figure 7:
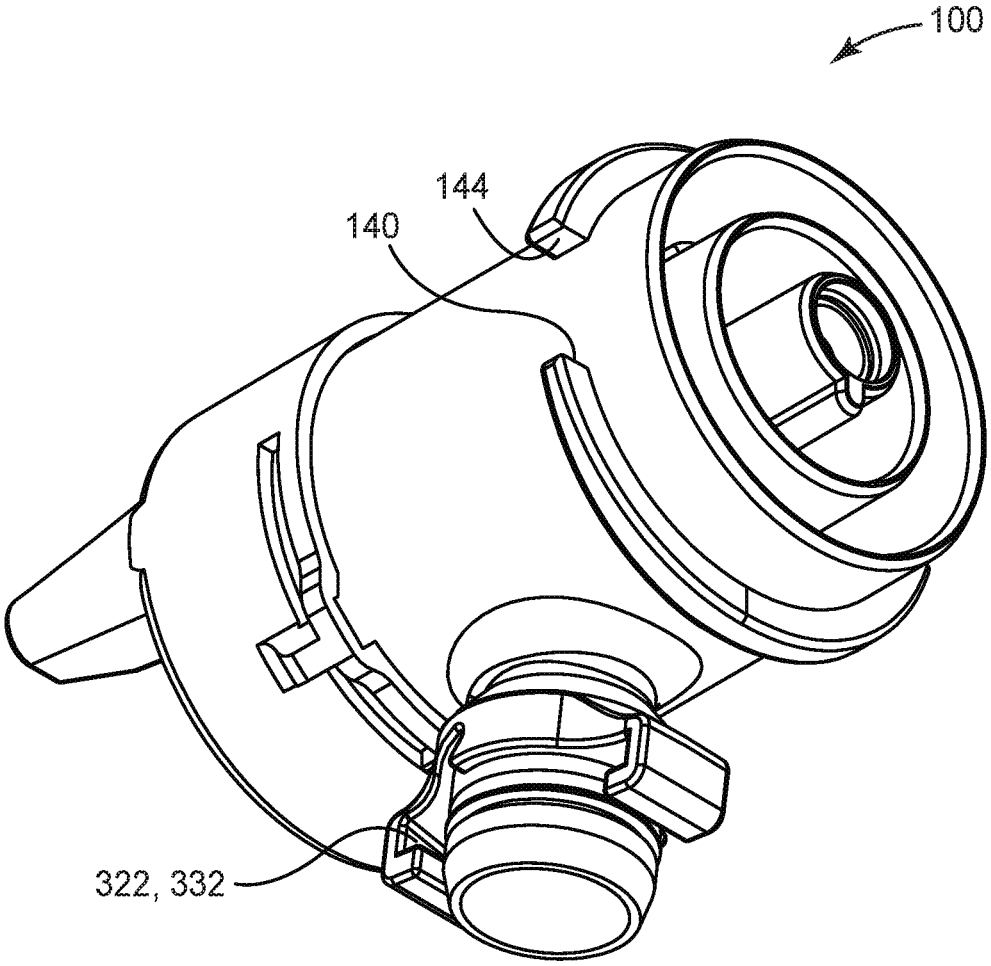
Figure 10:
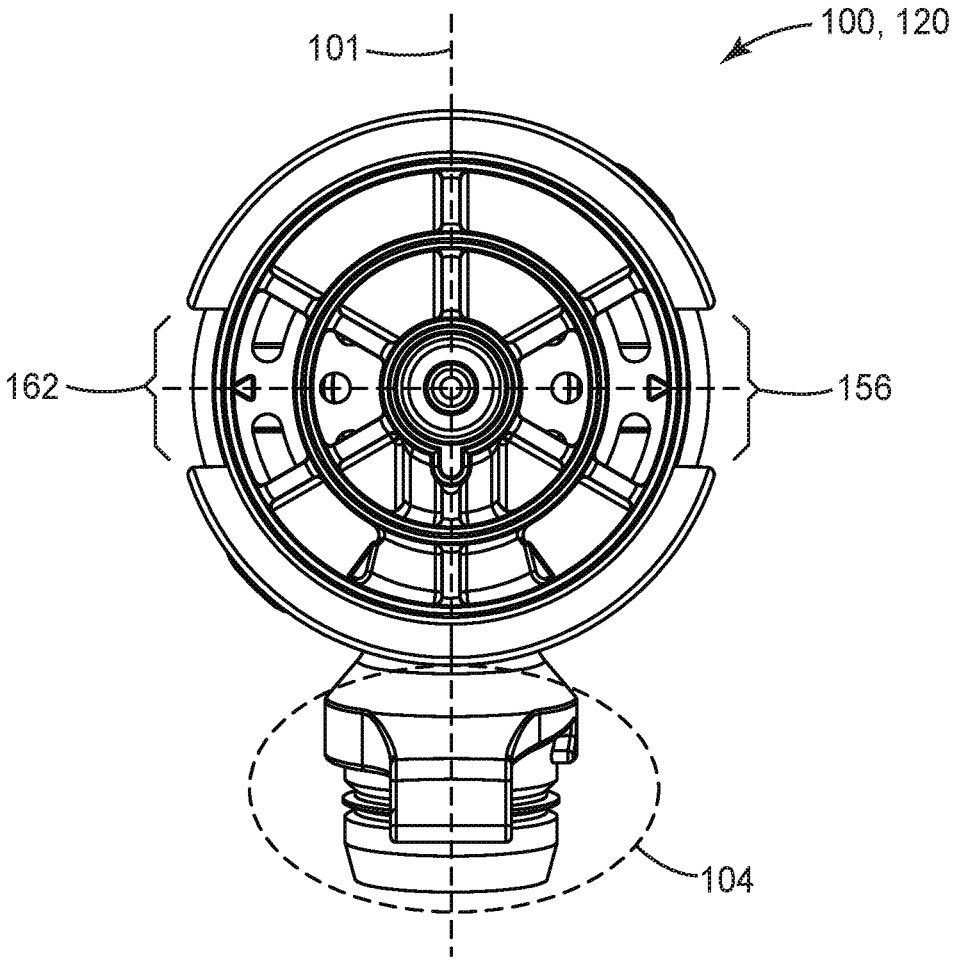
FIG. 10 is a rear view thereof.

The exemplary nozzle assembly connection portion 200 facilitates the attachment of the liquid spray gun nozzle assembly 100 to the liquid spray gun body 3 by way of a captured, rotatable locking ring 210, as seen in FIGS. 18 and 19 (or in FIGS. 4-6 of 62/430,383). FIG. 6 of 62/430,383 shows the nozzle assembly connection portion 200 as viewed along the spray axis 101. As shown, there is a shaping air port 202 and a center air port 204, through which shaping air and center air are respectively supplied to the liquid spray gun nozzle assembly 100. Also provided is a liquid needle port 206 within which the liquid needle 9' resides. A corresponding view of the spray gun connection portion 120 of a liquid spray gun nozzle assembly 100 is shown in FIG. 10.

Figure 13:
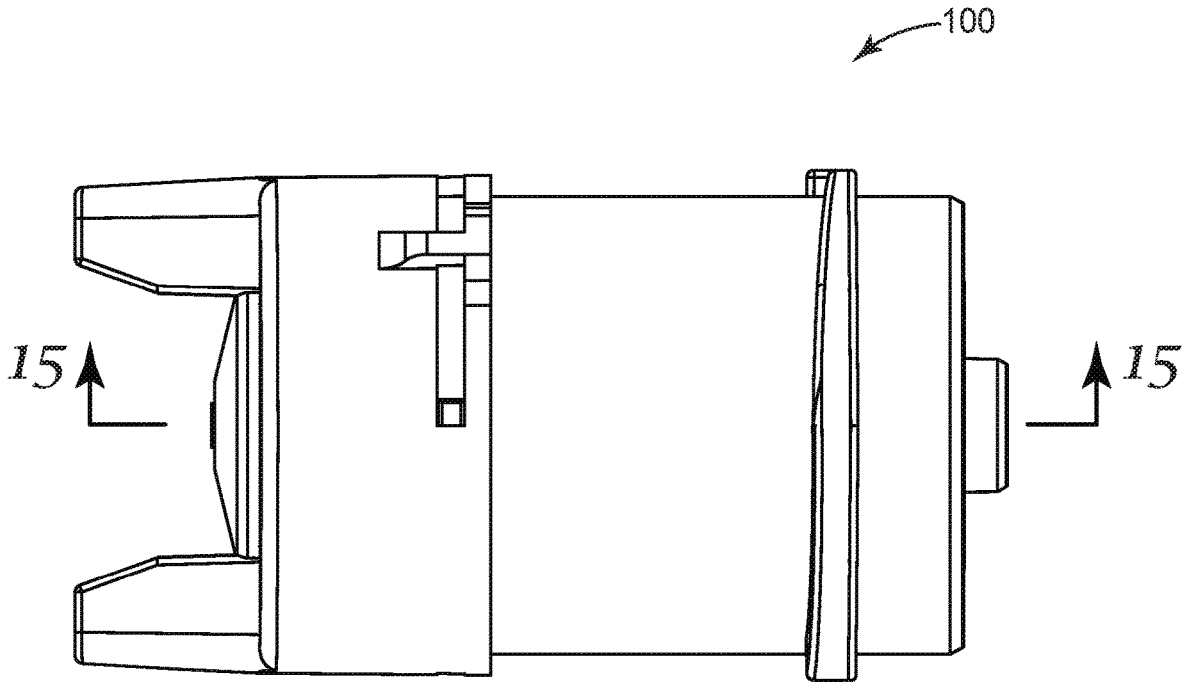
FIG. 13 is a top view thereof.
Figure 14:
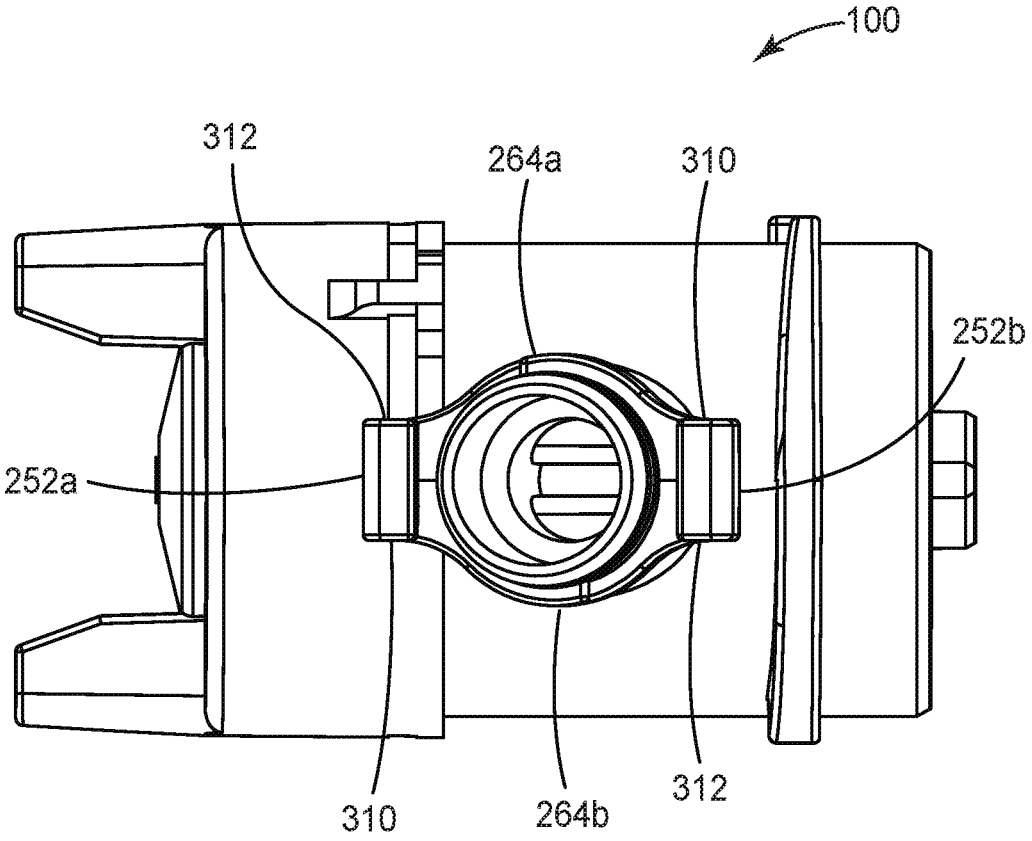
FIG. 14 is a bottom view thereof.

Referring now to the interaction between the nozzle assembly connection portion 200 and the spray gun connection portion 120, further reference is made to FIG. 19 and to FIGS. 6 and 13 of 62/430,383. When the liquid spray gun nozzle assembly 100 is attached to the nozzle assembly connection portion 200, various sealing features interact to isolate various zones, thereby allowing for appropriate control of air flow. For example, interactions are made in accordance with the following table:

TABLE 1

| On Spray Gun Connection Portion 120 of Liquid Spray Gun Nozzle Assembly 100 | On Nozzle Assembly Connection Portion 200 of Liquid Spray Gun 2 (as shown in 62/430,383) |
|---|---|
| First sealing member 168 → | ← First sealing seat 268 |
| Second sealing member 172 → | ← Second sealing seat 272 |
| Third sealing member 184 → | ← Third sealing seat 284 |

Figure 8:
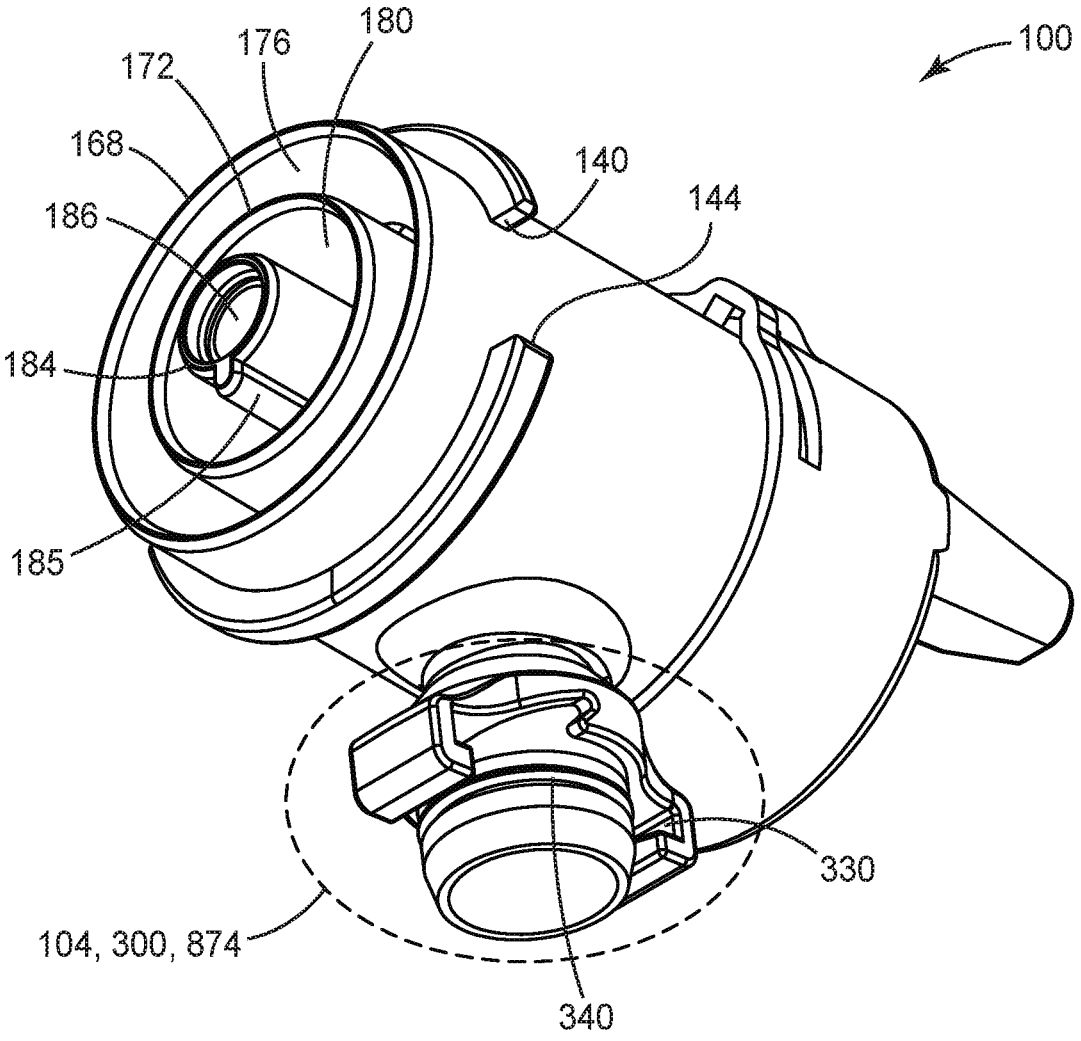
Figure 9:
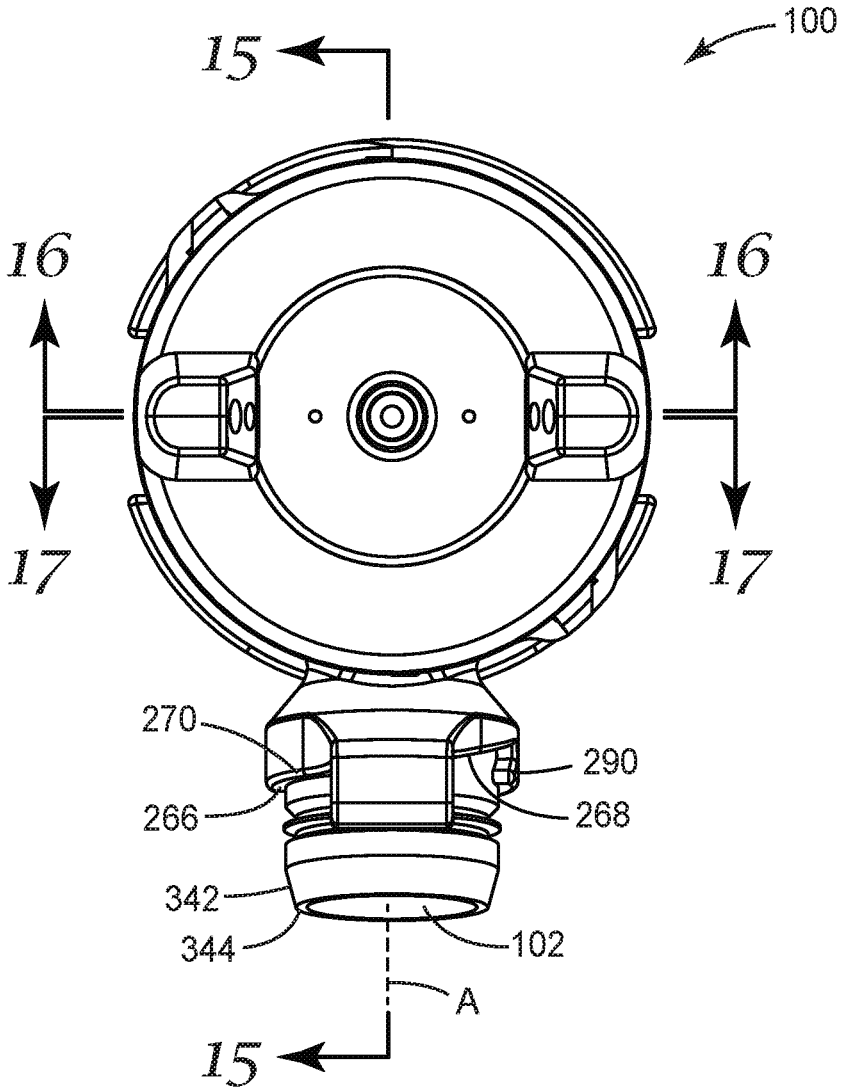
FIG. 9 is a front view thereof.

Provision of the aforementioned seals allows for isolation of a shaping air zone 176, a center air zone 180, and a liquid needle zone 186, as seen in FIG. 8. In other words, after connection and sealing, the shaping air port 202 supplies air to the shaping air zone 176, the center air port 204 supplies air to the center air zone 180, and the liquid needle port 206 facilitates provision of the liquid needle 9' in the liquid needle zone 186. It should be understood that the third sealing member 184 and third sealing seat 284 are optional, since sealing (e.g., a packing (not shown)) around the liquid needle 9' is typically already provided and thus coating liquid and compressed air are already fluidly isolated without the need of an additional seal against air in the center air zone. In such cases, there may still be a corresponding structure as shown at 184 (see, e.g., FIG. 8, or FIG. 17 of 62/430,383), but it need not achieve a sealing function.

In some embodiments, the first sealing member 168 and second sealing member 172 are essentially concentric. In some embodiments, the second sealing member 172 and third sealing member 184 are essentially concentric. In some embodiments, the first sealing member 168 and third sealing member 184 are essentially concentric. In some embodiments, the first sealing member 168, the second sealing member 172, and the third sealing member 184 are essentially concentric. "Essentially concentric," as used herein, means that the described features surround a and share a common axis (e.g., the spray axis 101) and are circular in shape, with allowances for irregularities in the circular shape(s). An example of an irregularity within the scope of the above definition is the nozzle alignment feature 185, which corresponds to the gun alignment feature 285 in the nozzle assembly connection portion 200. Such an irregularity can assist in enhancing rotational alignment of the spray gun nozzle assembly 100 with respect to a spray gun body 3.

In one embodiment, the respective sealing member(s) and sealing seat(s) provide a sealing function by way of a resiliently compressible material such as a gasket. Such a gasket may be provided as a separate part on either or both components that is attached by for example, snapping or adhesive. Alternatively, the gasket may be overmolded or insert molded onto (or within) one or both components.

In yet another embodiment, the sealing function is provided by deformation of one or more of the components themselves. In such embodiments, the relative geometry and materials of the liquid spray gun nozzle assembly 100 and the nozzle assembly connection portion 200 are chosen to interact to create a seal without the provision of separate components or special gasketing materials. For example, as can be seen in FIG. 17, the first and second sealing member 168 and 172 are provided as tapering rims that terminate in a pointed profile. These pointed profiles interact with the corresponding first and second sealing seats 268 and 272 such that either (depending on the relative hardness of the materials chosen) (i) the pointed profiles are slightly "crumpled" to form a seal; or (ii) the pointed profiles slightly bite or dig into the sealing seat(s). In some embodiments, both crumpling and digging occur in concert. In embodiments described by the paragraph, components can be simplified and manufactured in a less costly manner due to elimination of the need for additional sealing materials or parts. Although the tapering rims are shown in FIG. 17 of 62/430,383 as having a single tapering surface terminating at an apex, they could alternatively be constructed with two tapering surfaces meeting at an apex, etc., as shown with reference to FIGS. 8 and 15 herein.

In some embodiments, the sealing seats are provided as blind recessed receiving ports into which the sealing members can slide a distance prior to becoming fully seated against a blind end of the seat. In such embodiments, friction alone may provide sufficient sealing, or may be aided or solely provided by crumpling and/or digging as described above, or by sealing or gasketing materials as described above.

Regardless of the nature of the particular seal chosen, seals can be provided as a sliding seal (e.g., a piston-type seal) (see the interaction of the third sealing member 184 with the third sealing seat 284 depicted in FIGS. 6 and 17 of 62/430,383), a face seal (see the interaction between the first and second sealing members 168 and 172 with the first and second sealing seats 268 and 272 depicted in FIGS. 6 and 17 of 62/430,383), or combinations thereof.

As seen in FIGS. 18-20 of 62/430,383, the locking ring 210 comprises one or more camming lugs 230. As shown in the depicted embodiments, two camming lugs 230 are positioned opposite one another, spaced equidistantly about the circumference of the locking ring 210. Each camming lug 230 comprises a lug camming surface 232 positioned to interact with a camming surface 148 on a camming member (132, 136) located on the liquid spray gun nozzle assembly 100.

As shown in FIGS. 18 and 20 of 62/430,383, the locking ring 210 further comprises one or more guide features 240 to facilitate retention of the locking ring 210 on the spray gun body 3, and to guide controlled rotation of the locking ring. A guide member may optionally further comprise one or more snap features 242 that facilitate removable retention of the locking ring 210. An outer surface of the locking ring can comprise hand gripping features that permit the locking ring 210 to be moved to the assembly position 214 and the locked position 218 without the use of tools.

Turning now to FIGS. 7-12 of 62/430,383, the nozzle assembly connection portion 200 is shown with the locking ring 210 removed. One or more snap windows 246 are provided to correspond to the circumferential location(s) of the guide feature(s) 240 and snap feature(s) 242. The locking ring 210 can be assembled onto the nozzle assembly connection portion 200 by aligning the guide member(s) 240 with the snap window(s) 246 (corresponding to the assembly position 214) and translating the locking ring 210 onto the spray gun body 3 along the spray axis 101 such that the guide feature(s) 240 pass through the snap window(s) 246. When the locking ring is sufficiently moved into installed position, the one or more snap feature(s) snaps into a snap track 244, thereby holding the locking ring 210 in retained relation on the spray gun body 3, while still allowing for rotation. Also provided is a ring track 211 within which the guide feature(s) 240 can ride as the locking ring 210 is rotated. It can be seen that the snap feature(s) 242 can also rotate within the snap track 244.

In the embodiments shown, when viewing the nozzle assembly connection portion along the spray axis 101 as shown in FIGS. 6 and 6A of 62/430,383, the locking ring can then be rotated in the clockwise direction until the guide feature(s) 240 contact a distal ring rotation stop 213'. Conversely, the locking ring 210 can be rotated in the counterclockwise direction until the guide feature(s) 240 contact a proximal ring rotation stop 213 (corresponding again to the assembly position 214).

When the locking ring is in the assembly position 214, it is possible to remove the locking ring 210 from the spray gun body 3 by pulling outwardly along the spray axis 101, thereby disengaging the snap feature(s) 242 from the snap track 244 and permitting the guide feature(s) to be translated outwardly through the snap window(s) 246. In this way, the locking ring can be easily removed without the use of tools for cleaning or replacement should this become necessary. Herein lies an advantage of the disclosed system, whereby moving parts that could become contaminated with coating liquid over time can be easily accessed for cleaning or replacement. The locking ring 210 can be advantageously provided as a disposable part if desired, thereby minimizing replacement cost. Furthermore, the locking ring 210 can be constructed of a resilient material (such as an injection molded polymer) not only to reduce cost but also to provide the necessary resilience needed to perform the snapping functions as described herein (i.e., permitting the snap feature(s) 242 to move slightly to snap into and out of the snap track 244.

In an alternative embodiment, installation and/or removal of the locking ring 210 can take place in a position other than the assembly position. For example, in some embodiments the locking ring is further rotatable to a locking ring removal position that is distinct from the assembly position mentioned above. In one such embodiment, rotation from the assembly position through (and therefore past) the locked position can bring the locking ring to the locking ring removal position. This position cannot ordinarily be reached while the liquid spray gun nozzle assembly is installed due stoppage of rotation of the locking ring by interference with the camming members (i.e., because the locking ring will not then turn beyond a locking state). As a result, in such an embodiment there is no possibility of removing the locking ring while the liquid spray gun nozzle assembly is installed.

Turning now to, for example, FIGS. 1, 2, 7, 8, 10, and 11 (or in FIGS. 13-17 of 62/430,383), the spray gun connection portion 120 of the liquid spray gun nozzle assembly 100 is further described. The spray gun connection portion 120 comprises an outer wall 124 comprising a radially-outward facing surface 128. The radially-outward facing surface 128 comprises at least a first camming member 132. In the embodiments shown, the radially-outward facing surface 128 comprises a second camming member 136. Each camming member (132, 136) comprises a camming surface 148. In the embodiments shown, the camming surface(s) 148 face generally axially away from the spray gun connection portion 120 (i.e., away from the nozzle assembly connection portion 200 on the spray gun body 3 when the liquid spray gun nozzle assembly is installed thereon). One or both of the respective camming surface(s) 148 (and/or the lug camming surface(s) 232 on the locking ring 210) comprises an inclined portion 160 to facilitate a camming interaction.

Figure 11:
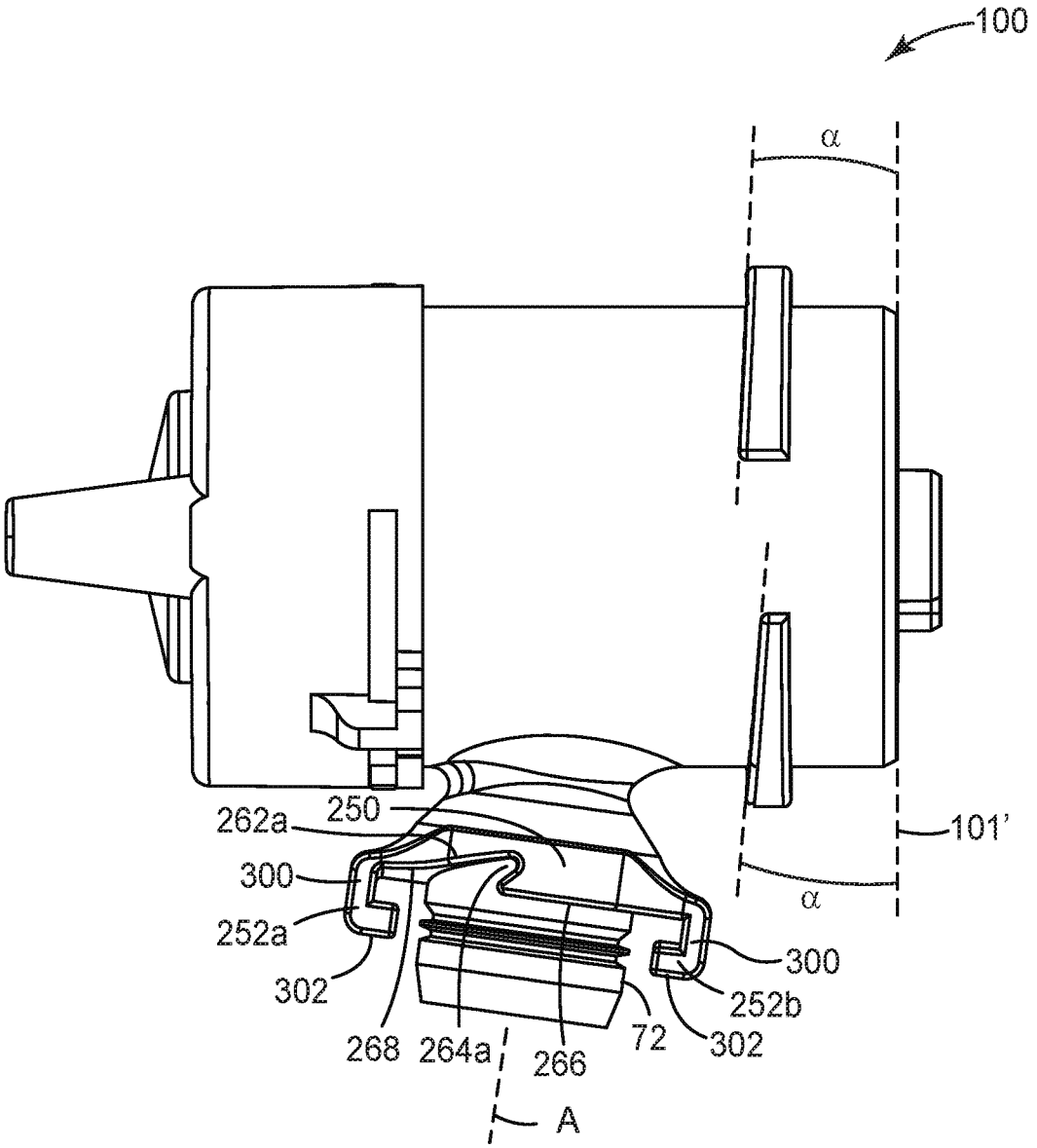
FIG. 11 is a right side view thereof.
Figure 12:
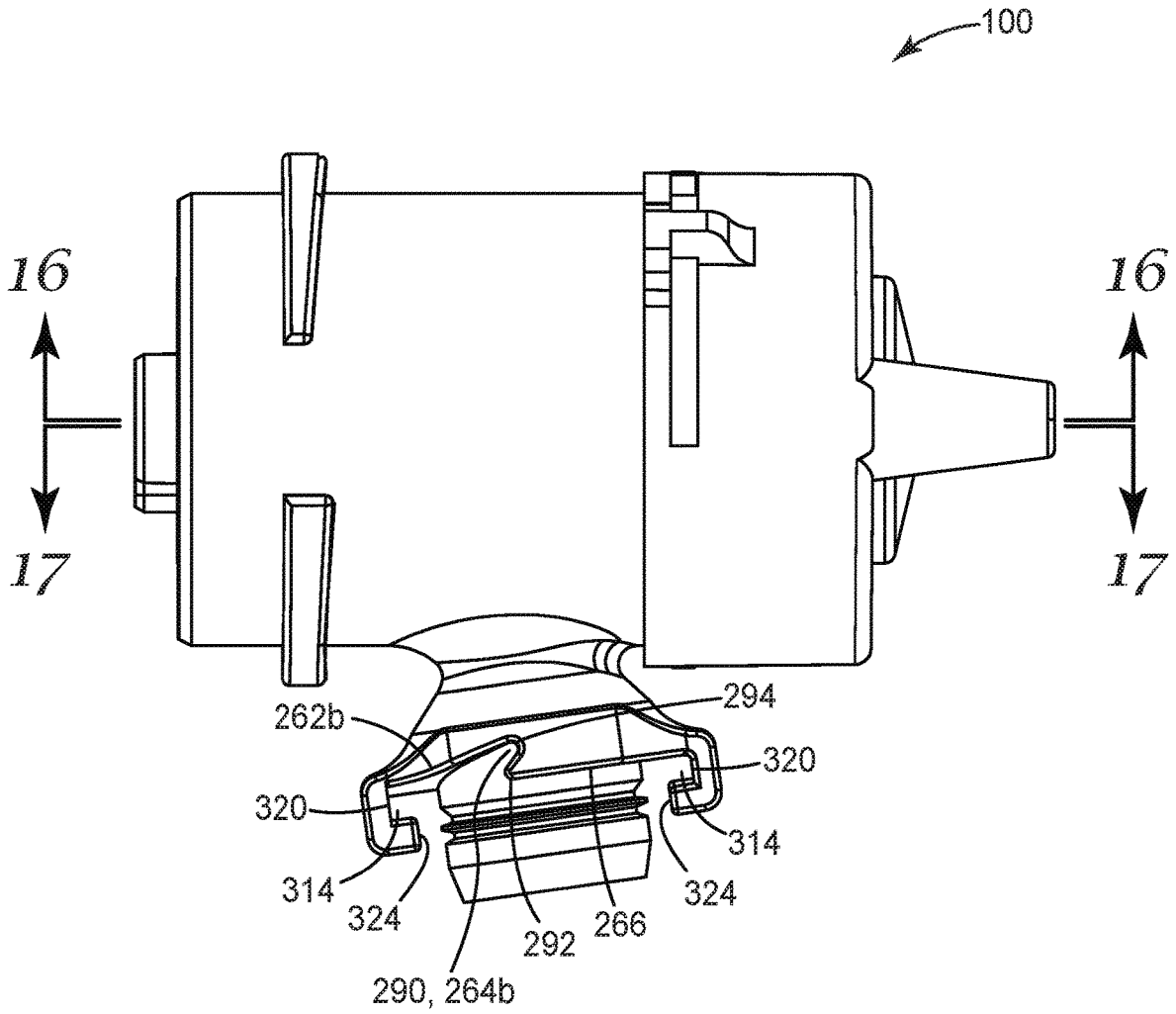
FIG. 12 is a left side view thereof.

As shown in FIG. 11 (or in FIGS. 15 and 16 of 62/430,383), a base plane 101' is defined perpendicular to the spray axis 101. It can be seen that the inclined portion(s) 160 comprise a portion that is inclined relative to the base plane 101' at an angle $\alpha$. Although the inclined portion(s) 160 are shown as flat surfaces (i.e., a linear incline, such that the entire inclined surface(s) 160 are inclined at the angle $\alpha$), it is also possible to provide the inclined surface(s) 160 as curved or other non-flat (i.e., non-linear) surfaces such that only a portion of the inclined surface(s) 160 are provided at the angle $\alpha$. The angle $\alpha$ is chosen to provide sufficient camming action to securely draw the liquid spray gun nozzle assembly 100 toward the spray gun body 3 while allowing for sufficient angular rotation of the locking ring 210 about an angle $\phi$ when travelling from the assembly position 214 to the locked position 218 (see, e.g., FIGS. 6 and 6A of 62/430,383). In some embodiments, the angle $\alpha$ is in a range from about 2 degrees to about 10 degrees, including, for example, 3, 4, 5, 6, 7, 8, or 9 degrees. In some embodiments, the angle $\phi$ is in a range from about 15 degrees to about 180 degrees, including, for example, 20, 30, 40, 50, 60, 70, 80, 90, 100, 11, 120, 130, 135, 140, 150, or 160 degrees. In some embodiments, the angle $\phi$ is in a range from about 45 degrees to about 140 degrees. In one embodiment, the angle $\alpha$ is about 5 degrees, while the angle $\phi$ is about 90 degrees (as shown rotated 90 degrees in the clockwise direction in FIG. 6A). In another embodiment, the angle $\alpha$ is about 5 degrees, while the angle $\phi$ is about 135 degrees. It should be understood that, for any given configuration, locking contact may occur at slightly varying angles $\phi$ depending on the angle $\alpha$, the interaction between the camming lug(s) 230 and the camming member(s) 132, and the tolerances of the cooperating parts.

Each camming member (132, 136) comprises a camming member first end 140 and a camming member second end 144. An access window (152, 156) is located circumferentially between a camming member second end 144 and a camming member first end 140. In the embodiments shown, a first camming member 132 and second camming member 136 are provided, thereby providing a first access window 152 and a second access window 156.

Turing back now to FIGS. 7-12 of 62/430,383, the nozzle assembly connection portion may be further provided with one or more nozzle keys 212. The nozzle key(s) align with the first and/or second access window(s) (152, 156) on the liquid spray gun nozzle assembly 100 to prevent rotation of the liquid spray gun nozzle assembly 100 relative to the spray gun body 3. In the embodiments shown the nozzle key(s) 212 fits snugly between a camming surface first end 140 and a camming surface second end 144. In this way, the liquid spray gun nozzle assembly 100 is held in a rotationally fixed manner while the locking ring 210 is rotated to the assembly position 214 and the locked position 218. The nozzle key(s) 212 in cooperation with the first and/or second access window(s) (152, 156) further provide helpful alignment to insure that the spray gun nozzle assembly 100 is correctly rotationally positioned for installation onto the nozzle assembly connection portion 200 of the spray gun body 3.

The locking ring 210 is rotatable to an assembly position 214 (see FIG. 6 of 62/430,383) and a locking position 218 (see FIG. 6A). In the embodiments shown, in the assembly position 214, one or more camming lugs 230 are positioned such that they correspond in position to the one or more nozzle keys 212. The first and/or second access windows (152, 156) are then positioned adjacent to the one or more camming lugs 230 and nozzle keys 212. The one or more camming lugs 230 and nozzle keys 212 are then passed through the first and/or second access windows by translating the spray gun nozzle assembly toward the nozzle assembly connection portion 200.

Then, upon proper location of the spray gun nozzle assembly 100 against the nozzle assembly connection portion 200 (while the locking ring 210 is in the assembly position 214), the locking ring 210 can be rotated into the locked position 218 to securely retain the spray gun nozzle assembly 100 thereon. During rotation of the locking ring 210 from the assembly position 214 to the locked position 218, the lug camming surface(s) 232 engage the camming surface(s) 148 on the spray gun nozzle assembly, thereby interacting with the inclined portion(s) 160 to pull the spray gun nozzle assembly 100 axially (along the spray axis 101) toward the spray gun body 3. Meanwhile, the one or more nozzle keys 212 retain the spray gun nozzle assembly in rotational position with respect to the nozzle assembly connection portion 200. The locking ring 210 is rotated from the assembly position 214 with manual rotational force (i.e., by hand) until sufficient axial force is generated to create a sufficient operational seal between the various sealing members and sealing seats described elsewhere herein. This is the locked position. Sufficient friction is created by interaction of the lug camming surface(s) 232 and the camming surface(s) 148 to retain the locking ring in the locked position 218 until the user wishes to remove the spray gun nozzle assembly.

For removal, the user rotates the locking ring 210 into the assembly position, thereby again aligning the one or more camming lugs 230 with the first and/or second access windows (152, 156). The spray gun nozzle assembly 100 can then be pulled away from the nozzle assembly connection portion 200, thereby passing the one or more camming lugs 230 through the first and/or second access windows (152, 156) to separate the components.

Provision of a locking ring 210 and corresponding features as shown and described herein can allow for secure, easy, tool-free assembly and removal of a spray gun nozzle assembly 100 from a spray gun body 3. The embodiments shown and described can also provide for easy removal, cleaning, and cost-effective replacement (if necessary) of the locking ring 210.

Although the invention herein has been described with reference to particular embodiments, it is to be understood that these embodiments are merely illustrative of the principles and applications of the present invention. It will be apparent to those skilled in the art that various modifications and variations can be made to the method and apparatus of the present invention without departing from the spirit and scope of the invention. Thus, it is intended that the present invention include modifications and variations that are within the scope of the appended claims and their equivalents.

What is claimed is:

1. A liquid spray gun nozzle assembly for a pressure-fed liquid spray gun comprising a coating liquid inlet portion comprising a liquid connector for connection to an external liquid source;

a coating liquid outlet portion comprising a liquid nozzle for spraying a coating liquid fed into the nozzle assembly through the coating liquid inlet portion, the liquid nozzle being disposed along a spray axis;

a coating liquid flow path fluidly connecting the coating liquid inlet portion to the liquid nozzle;

a spray gun connection portion opposite the coating liquid outlet portion adapted to connect the liquid spray gun nozzle assembly to a compatible liquid spray gun body, the spray gun connection portion comprising a nozzle assembly sealing surface adapted to seal the liquid spray gun nozzle assembly to the compatible liquid spray gun body, the nozzle assembly sealing surface comprising first and second sealing members that are each circular and concentric with one another, wherein upon connection of the liquid spray gun nozzle assembly to the compatible liquid spray gun body, a shaping air zone is concentric with, and isolated between, the first and second sealing members.

2. The liquid spray gun nozzle assembly of claim 1 wherein the first and second sealing members are concentric about the spray axis.

3. The liquid spray gun nozzle assembly of claim 1 wherein, upon connection to the compatible liquid spray gun body, a center air zone is isolated within the second sealing member.

4. The liquid spray gun nozzle assembly of claim 1 wherein the nozzle assembly sealing surface comprises a third sealing member that is circular and concentric with the first and second sealing members.

5. The liquid spray gun nozzle assembly of claim 4 wherein, upon connection to the compatible liquid spray gun body, a center air zone is isolated between the second and third sealing members.

6. The liquid spray gun nozzle assembly of claim 4 wherein, upon connection to the compatible liquid spray gun body, a liquid needle is isolated within the third sealing member.

7. The liquid spray gun nozzle assembly of claim 1 wherein the liquid connector comprises a first connector portion comprising a first connector format comprising a guide surface and a retention structure.

8. The liquid spray gun nozzle assembly of claim 7 further comprising an adapter configured to allow connection of the liquid connector to an external liquid source, the adapter comprising a second connector portion comprising a second connector format configured to connect to the first connector format on the liquid connector for assembly onto the liquid connector.

9. The liquid spray gun nozzle assembly of claim 8 wherein the second connector format comprises a tracking face an a lock structure, wherein the lock structure is configured to selectively interface with the retention structures, and the tracking face is configured to interface with the guide surface.

10. A liquid spray gun assembly comprising a liquid spray gun body; and a liquid spray gun nozzle assembly according to claim 1.

11. The liquid spray gun assembly of claim 10 wherein the liquid spray gun body comprises a captured rotatable locking ring for connection of the liquid spray gun nozzle assembly.

12. The liquid spray gun assembly of claim 11 wherein the captured rotatable locking ring comprises first and second camming lugs adapted to interact with the first and second camming surfaces on the liquid spray gun nozzle assembly.

13. The liquid spray gun assembly of claim 12 wherein the captured rotatable locking ring is rotatable about the spray axis to an assembly position and a locked position, wherein, in the assembly position, the first and second camming lugs are aligned with the first and second access windows, respectfully, to allow installation or removal of the liquid spray gun nozzle assembly; and in the locked position, the first and second camming lugs bear against the first and second camming surfaces, respectfully, to lock the liquid spray gun nozzle assembly against the liquid spray gun body.

14. The liquid spray gun assembly of claim 13 wherein rotation of the captured rotatable locking ring from the assembly position to the locked position is less than 180 degrees about the spray axis.

15. The liquid spray gun assembly of claim 14 wherein rotation of the captured rotatable locking ring from the assembly position to the locked position is less than 140 degrees about the spray axis.

16. The liquid spray gun assembly of claim 11 wherein the captured rotatable locking ring is installable onto the liquid spray gun body by pushing the captured rotatable locking ring along the spray axis, and is removable from the liquid spray gun body by pulling along the spray axis.

17. The liquid spray gun assembly of claim 16 wherein the captured rotatable locking ring is rotatable about the spray axis to an assembly position and a locked position, wherein the captured rotatable locking ring is installable onto and removable from the liquid spray gun body when rotated to the assembly position, but not removable when rotated to the locked position.

18. The liquid spray gun assembly of claim 16 wherein the captured rotatable locking ring is installable and removable from the liquid spray gun body via a snapping feature.

19. The liquid spray gun assembly of claim 16 wherein the captured rotatable locking ring is installable and removable from the liquid spray gun body without the use of a tool.

20. A method of using a liquid spray gun assembly according to claim 10 comprising installing the liquid spray gun nozzle assembly onto the liquid spray gun body.

* * * * *